US010104941B2

(12) United States Patent
Dieter

(10) Patent No.: US 10,104,941 B2
(45) Date of Patent: Oct. 23, 2018

(54) CUSTOMIZATION KIT FOR ARTICLES OF FOOTWEAR

(71) Applicant: NIKE, Inc., Beaverton, OR (US)

(72) Inventor: William M. Dieter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 296 days.

(21) Appl. No.: 15/053,671

(22) Filed: Feb. 25, 2016

(65) Prior Publication Data

US 2017/0245598 A1 Aug. 31, 2017

(51) Int. Cl.

| | |
|---|---|
| ***A43D 95/12*** | (2006.01) |
| ***B65D 33/01*** | (2006.01) |
| ***B65D 33/14*** | (2006.01) |
| ***B65D 85/18*** | (2006.01) |

(52) U.S. Cl.

CPC ..... *A43D 95/12* (2013.01); *B65D 33/01* (2013.01); *B65D 33/14* (2013.01); *B65D 85/187* (2013.01)

(58) Field of Classification Search

CPC ..... B65D 33/01; B65D 33/14; B65D 85/187; A43D 999/00; A43D 95/12; A47J 36/20; A43B 7/28; A43B 23/0215

USPC ..... 383/33

See application file for complete search history.

(56) References Cited

U.S. PATENT DOCUMENTS 1,521,184 A * 12/1924 Holton ..... A47J 47/18 220/904
1,733,486 A * 10/1929 Eager ..... A43D 95/12 12/142 K
3,380,646 A 4/1968 Doyen
4,057,144 A 11/1977 Schuster
4,837,849 A 6/1989 Erickson
4,892,604 A 1/1990 Measells
5,080,643 A 1/1992 Mitchell
5,289,937 A * 3/1994 Boots ..... B65D 88/1631 220/666
5,564,833 A * 10/1996 Proffitt ..... B65D 88/1618 383/105
5,735,423 A 4/1998 Black
5,842,790 A * 12/1998 Imer ..... B65D 31/08 383/104
5,947,287 A 9/1999 Weiss
6,203,198 B1 * 3/2001 Stone ..... B65D 88/1625 220/9.2
6,220,755 B1 * 4/2001 Brown ..... B65D 88/1625 383/109
6,231,237 B1 5/2001 Geller
8,109,476 B2 2/2012 Roberts
8,574,281 B2 11/2013 Vracknos
8,845,331 B2 9/2014 Monicelli
9,783,332 B2 * 10/2017 Untch ..... B65D 1/42

(Continued)

FOREIGN PATENT DOCUMENTS

KR 20080001508 U 1/2008

*Primary Examiner* — Robert B Davis
(74) *Attorney, Agent, or Firm* — Banner & Witcoff, Ltd.

(57) ABSTRACT

A steaming apparatus for an article of footwear includes a steaming chamber adjoined to a plurality of wing portions. The steaming apparatus is configured to accommodate a steam source. The apparatus also includes provisions for securing the article of footwear within the steaming chamber such that a majority of the upper is subjected to steam. Articles of footwear may be placed in the steaming system to help customize the articles of apparel for a user's fit and comfort.

26 Claims, 18 Drawing Sheets

(56) References Cited

U.S. PATENT DOCUMENTS

| | | | | |
|---|---|---|---|---|
| 2006/0049181 | A1 | 3/2006 | Tuhkru | |
| 2007/0086681 | A1 * | 4/2007 | Richardson, Jr. .. | B65D 88/1618 383/16 |
| 2014/0169704 | A1 | 6/2014 | Dieter | |
| 2015/0175343 | A1 | 6/2015 | Baker | |
| 2015/0344189 | A1 | 12/2015 | Sasaki | |

* cited by examiner

CUSTOMIZATION KIT FOR ARTICLES OF FOOTWEAR

BACKGROUND

The present embodiments relate to an apparatus and method of custom fitting articles, and in particular to a post-manufacturing customization system and method of custom fitting an article of footwear through the application of steam.

Steam can be used to soften articles of apparel. Articles of footwear often include an upper and a sole structure. The upper comprises many different components, including various layers, sections, or segments of material. These components may be made from stock textile materials such as fabrics and leather goods that may be customized for a user.

SUMMARY

In one aspect, the present disclosure is directed to a kit of parts, comprising an assembled article of footwear including a customizable portion, the customizable portion being customizable when heated above a predetermined temperature, and a steaming bag configured to receive and hold the assembled article of footwear in a steam environment. The steaming bag includes a steaming chamber and a plurality of wing portions, and the steaming chamber includes a receiving end, a base portion, and a footwear receiving portion. In addition, the footwear receiving portion extends between the base portion and the receiving end, and the base portion includes at least one aperture. The plurality of wing portions extend substantially radially outward from the steaming chamber when the steaming bag is erected. Furthermore, the plurality of wing portions include a first wing portion that extends outward from a first edge of the steaming chamber, and the first wing portion includes a first channel configured to receive a first elongated element.

In another aspect, the present disclosure is directed to a steaming bag configured to receive and hold an assembled article of footwear in a steam environment, the steaming bag comprising a flattened configuration and an erected configuration, a steaming chamber including four sidewall portions joined along four edge portions, and four wing portions, where each wing portion of the four wing portions is joined to one edge portion of the steaming chamber. Each of the four wing portions includes an elongated channel, and the steaming chamber has a receiving end, a base portion, and a footwear receiving portion, where the footwear receiving portion extends upward from the base portion to the receiving end. In addition, each of the four wing portions extend substantially radially outward from the steaming chamber when the steaming bag is in the erected configuration.

In another aspect, the present disclosure is directed to a method of using a steaming bag, comprising grasping a first wing portion and a second wing portion of a steaming apparatus, pulling the first wing portion in a first direction and pulling the second wing portion in a second direction, where the first direction is substantially opposite to the second direction, and erecting the steaming bag on a surface.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
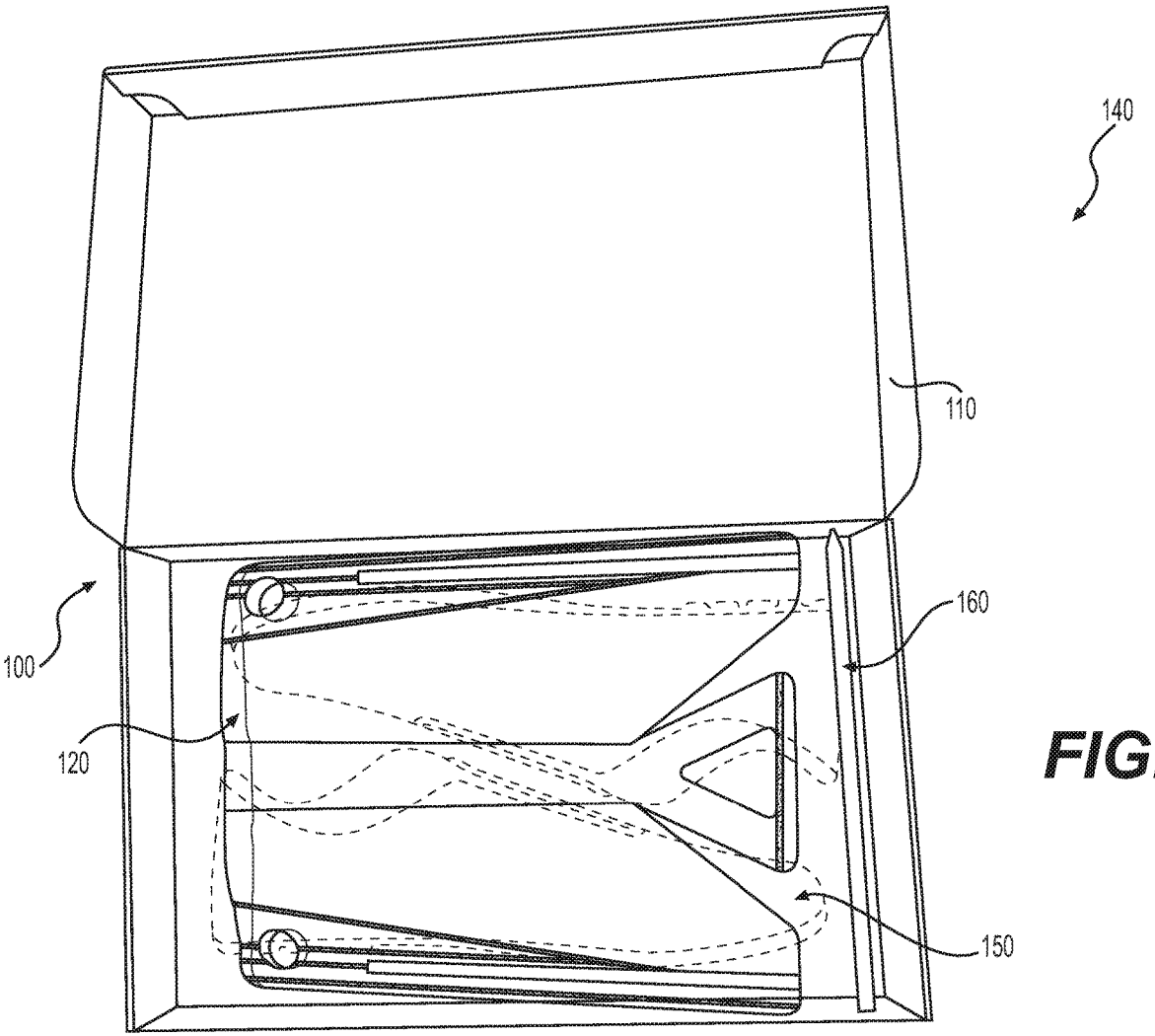
FIG. 1 is a top-down view of an embodiment of a customization kit.
Figure 2:
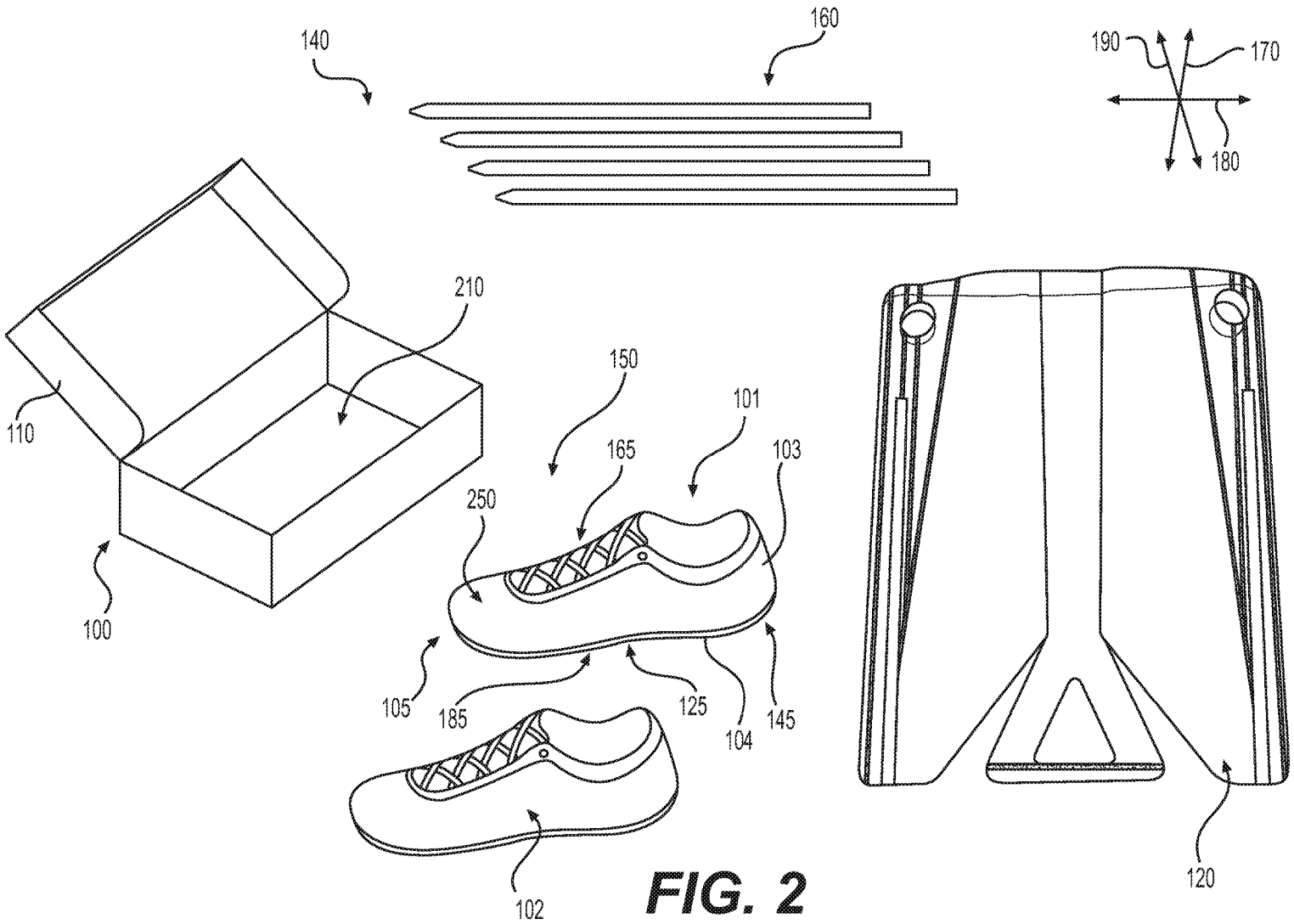
FIG. 2 is an exploded view of an embodiment of the customization kit of FIG. 1.

Generally, a post-manufacturing customization system and method of custom fitting an article of footwear may be configured by providing a customer with an apparatus for steaming an article of footwear. FIGS. 1 and 2 depict an embodiment of a customization kit 140. Customization kit 140 includes a container 100 with a lid 110, where container 100 is configured to receive at least one article of footwear. Customization kit 140 further includes a steaming apparatus 120. In some embodiments, customization kit 140 may also include a plurality of elongated elements ("elongated elements") 160. In some embodiments, as shown in FIG. 1, customization kit 140 also comprises a pair of footwear 150, depicted in dotted lines in FIG. 1 and located within an interior of container 100. FIG. 2 shows an exploded view of customization kit 140 of FIG. 1, where pair of footwear 150, elongated elements 160, and steaming apparatus 120 have been removed from the interior of container 100. It should be understood that the following figures are for purposes of illustration only, and each of the components described herein may be included or referred to in the description while not illustrated in the figures.

In different embodiments, customization kit 140 may be used by a customer at home. For example, in some cases, a customer could purchase customization kit 140 at a retail location and bring customization kit 140 to his or her home. In other cases, customization kit 140 may be shipped to an address associated with the customer. In other embodiments, customization kit 140 could be used at any other location, such as a retail store or a kiosk.

Furthermore, the term "container" as used throughout this detailed description and in the claims refers to any housing, enclosure, container, or other structure that can be configured to store one or more articles. Moreover, as used herein, "container" refers to any housing, enclosure, container, or other structure that may be moved from one location to another. Specifically, a container may be any container that is not required to be permanently secured or fixedly attached to a surface in order to operate, and is capable of being readily displaced by a single individual. The shape of the container can vary in different embodiments. In some cases, the container may have a substantially box-like shape. In other cases, a container may have an approximately cuboid or rectangular prism shape. Examples of other shapes for a container include, but are not limited to, curved or rounded shapes, polygonal shapes, regular shapes, irregular shapes as well as any other kinds of shapes. In some cases, a container and lid may include a structure that allows the apparatus to stand or be otherwise independently stable when placed on a surface (e.g., without additional supportive components or mounting elements).

In different embodiments, container 100 and lid 110 may comprise a shoebox. For purposes of this disclosure, a shoebox can comprise of a four-sided structure with a bottom portion, where the bottom portion is joined to the four-sided structure and forms a box. The shoebox includes a lid that can be used to cover the top opening and form a substantially closed six-sided structure with an interior chamber. The shoebox structure can enclose or hold articles of footwear placed within the interior chamber. Thus, in some embodiments, container 100 can be a shoebox that is sized and dimensioned to hold a pair of footwear. In one embodiment, container 100 may be a shoebox that is sized and dimensioned to hold a single article of footwear. In the embodiment of FIG. 2, container 100 includes a chamber 210 configured to hold pair of footwear 150 and other components of customization system 140.

Referring to FIG. 2, customization kit 140 can include various different components for customizing one or more articles of footwear. As noted above, in one embodiment, customization kit 140 can include pair of footwear 150. Pair of footwear 150 may further comprise a first article of footwear ("first article") 101 and second article of footwear ("second article") 102. Generally, articles of footwear associated with customization kit 140 can be any type of footwear. For clarity, the following detailed description discusses articles of footwear in the form of sports shoes, but it should be noted that in other embodiments any other type of footwear could be used including, but not limited to, hiking boots, soccer shoes, football shoes, sneakers, rugby shoes, basketball shoes, baseball shoes, as well as other kinds of shoes. Articles of footwear associated with customization kit 140 may also take the form of any non-athletic shoe, including, but not limited to, dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures. Additionally, while a single article of footwear is shown in later figures, it should be understood that the same principles taught in this detailed description could be applied to a second, complementary article of footwear.

First article of footwear 101 and second article of footwear 102 may be oriented for a left foot and a right foot, respectively. In other words, first article 101 and second article 102 comprise a complementary pair of footwear in FIG. 2. For purposes of this discussion, a complementary pair of footwear refers to two articles of footwear that are designed to be worn as a pair by one user on a right foot and a left foot. Similarly, a complementary pair of sole members refers to two sole members that are designed or configured for use by one user on a left foot and a right foot. For purposes of clarity, the following detailed description discusses first article of footwear 101, but it will be understood that each of the features discussed for first article of footwear 101 could also apply to second article of footwear 102. Furthermore, first article of footwear 101 may also be referred to simply as first article 101 throughout the remainder of this detailed description.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments. The term "longitudinal" as used throughout this detailed description and in the claims refers to a direction extending a length of a component (e.g., an upper or sole component). A longitudinal direction may extend along a longitudinal axis, which itself extends between a forefoot region and a heel region of the component. The term "forward" is used to refer to the general direction in which the toes of a foot point, and the term "rearward" is used to refer to the opposite direction, i.e., the direction in which the heel of the foot is facing. The terms forward and rearward may be used to describe the location of elements relative to one another along the sole structure.

In addition, the term "lateral" as used throughout this detailed description and in the claims refers to a direction extending along a width of a component. A lateral direction may extend along a lateral axis, which itself extends between a medial side and a lateral side of a component. In other words, the lateral direction may extend between a medial side and a lateral side of an article of footwear, with the lateral side of the article of footwear being the surface that faces away from the other foot, and the medial side being the surface that faces toward the other foot.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading toward the ground surface. Similarly, the terms "top," "upper" (when not used in context of the upper component in an article of footwear), and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. In addition, the term "proximal" refers to a direction that is nearer a center of a footwear component, or is closer toward a foot when the foot is inserted in the article as it is worn by a user. Likewise, the term "distal" refers to a relative position that is further away from a center of the footwear component or upper. Thus, the terms proximal and distal may be understood to provide generally opposing terms to describe the relative spatial position of a footwear layer.

In the exploded view of FIG. 2, it can be seen that first article 101 includes a sole structure 104 and an upper 103. As noted above, for consistency and convenience, directional adjectives are employed throughout this detailed description. Thus, first article 101 (and other articles in this description) may be divided into three general regions along a longitudinal axis 180: a forefoot region 105, a midfoot region 125, and a heel region 145. Forefoot region 105 generally includes portions of first article 101 corresponding with the toes and the joints connecting the metatarsals with the phalanges. Midfoot region 125 generally includes portions of first article 101 corresponding with an arch area of the foot. Heel region 145 generally corresponds with rear portions of the foot, including the calcaneus bone. Forefoot region 105, midfoot region 125, and heel region 145 are not intended to demarcate precise areas of first article 101. Rather, forefoot region 105, midfoot region 125, and heel region 145 are intended to represent general relative areas of first article 101 to aid in the following discussion.

In addition, referring to FIG. 2, for reference purposes, a lateral axis 190 of first article 101, and any components related to first article 101, may extend between a medial side 165 and a lateral side 185 of the foot. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

As noted above, first article 101 may include upper 103 and sole member 104. Generally, upper 103 may be any type of upper. In particular, upper 103 may have any design, shape, size, and/or color. For example, in embodiments where first article 101 is a basketball shoe, upper 103 could be a high-top upper that is shaped to provide high support on an ankle. In embodiments where first article 101 is a running shoe, upper 103 could be a low-top upper.

As shown in FIG. 2, upper 103 may include one or more material elements (for example, meshes, textiles, foam, leather, and synthetic leather), which may be joined to define an interior void configured to receive a foot of a wearer. The material elements may be selected and arranged to impart properties such as light weight, durability, air permeability, wear resistance, flexibility, and comfort. Upper 103 may define an opening through which a foot of a wearer may be received into the interior void.

In different embodiments, a sole structure may include different components. For example, the sole structure may include an outsole, a midsole, a cushioning layer, and/or an insole. In addition, in some cases, a sole structure can include one or more cleat members or traction elements that are configured to increase traction with a ground surface. In some embodiments, the sole structure may include multiple components, which may individually or collectively provide first article 101 with a number of attributes, such as support, rigidity, flexibility, stability, cushioning, comfort, reduced weight, or other attributes. In some embodiments, the sole structure may include an insole/sockliner, a midsole, and a ground-contacting outer sole member ("outsole"), which may have an exposed, ground-contacting lower surface. In some cases, however, one or more of these components may be omitted.

At least a portion of the sole structure may be fixedly attached to upper 103 (for example, with adhesive, stitching, welding, or other suitable techniques) and may have a configuration that extends between upper 103 and the ground. The sole structure may include provisions for attenuating ground reaction forces (that is, cushioning and stabilizing the foot during vertical and horizontal loading). In addition, the sole structure may be configured to provide traction, impart stability, and control or limit various foot motions, such as pronation, supination, or other motions.

In some embodiments, the sole structure may be configured to provide traction for first article 101. In addition to providing traction, the sole structure may attenuate ground reaction forces when compressed between the foot and the ground during walking, running, or other ambulatory activities. The configuration of sole structure 104 may vary significantly in different embodiments to include a variety of conventional or non-conventional structures. In some cases, the configuration of components of the sole structure can be configured according to one or more types of ground surfaces on which the sole structure may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which first article 101 is anticipated to be used. For example, sole structure 104 may vary depending on whether the surface is hard or soft. In addition, the sole structure may be tailored for use in wet or dry conditions.

Furthermore, in some embodiments, an article of footwear can be configured with one or more customizable portions. The term "customizable portion" as used throughout this detailed description refers to a portion with characteristics that can be customized. Examples of such characteristics include, but are not limited to, size, shape, material properties (such as rigidity and/or flexibility) as well as other properties. In one embodiment, a customizable portion may be a portion with a size and/or shape that can be adjusted. In addition, in some cases, the material properties of a customizable portion could also be adjusted. For example, in FIG. 2, a customizable portion 250 is shown, generally corresponding to upper 103. However, in other embodiments, customizable portion 250 can comprise a region or segment of the upper or an article of footwear. In different embodiments, the fit of the upper can be customized upon application of steam through the inclusion of customizable portions.

The characteristics of customizable portions can be varied in different ways. In some embodiments, a customizable portion can be varied through a curing process. In other words, the customizable portion may be heated above a predetermined temperature and modified before cooling the customizable portion so that the modifications are retained. In other embodiments, the characteristics of customizable portions can be varied through the use of pressure, chemical additives or other known methods of changing the characteristics of material including the size, shape, rigidity, flexibility, and/or other properties. In still other embodiments, a combination of heat, pressure, and/or chemicals could be used to modify the customizable portion.

Generally, an article as discussed herein in relation to steaming apparatus 120 can comprise one or more customizable portions. In some embodiments, an upper may be associated with one or more customizable portions. In other embodiments, one or more layers of a sole structure may be associated with one or more customizable portions. In other cases, a customizable portion may be associated with any combination of different portions of an upper and sole structure or other portions of an article of footwear. In particular, the customizable portions may extend through a substantial majority of an upper and/or an insole. Using this arrangement, articles can be custom shaped to the specific geometry of the foot of a user to enhance comfort and fit in different embodiments.

In different embodiments, customizable portions can be made from any known materials or combination of materials. Examples of materials that may be used include, but are not limited to: any kind of thermoset polymers, thermoplastics, thermoset resins (such as epoxy, vinlyester and polyster), synthetic leathers including poromeric leathers and lorica, as well as any other kinds of materials with customizable characteristics. In an exemplary embodiment, a customizable portion may be constructed as a synthetic leather comprising two polymer layers that sandwich a canvas sheet. Moreover, a glue used to bond the polymer layers to the canvas may be configured with a relatively low melting point. When steamed, this glue can stretch or shrink to accommodate a customized shape. Although the current embodiment discusses a three-layered construction, other customizable portions could incorporate any other number of layers including a single layer construction.

In order to modify any customizable portions, an article may be heated above a predetermined temperature. For example, in embodiments where a customizable portion may transition between a crystalline phase and a liquid-like phase, the predetermined temperature can be a glass transition temperature. In some cases, the glass transition temperature is useful in characterizing amorphous solids such as plastics or similar materials that may not have a true melting point. However, in other cases, the predetermined temperature can be some other temperature at which a customizable portion may become substantially more deformable. In some cases, articles may be placed in an oven. In other cases, articles may be heated using steam. In one embodiment, articles may be heated in any steam environment. A steam environment can be created in different ways. In some cases, a steam environment can be created using steaming apparatus 120. Thus, by selecting materials for an article of footwear that become substantially more deformable at temperatures less than or equal to the temperature of steam, a customizable portion can be activated by applying steam to an article of footwear using steaming apparatus 120.

Thus, the materials comprising the various portions of steaming apparatus 120 and/or elongated elements 160 may vary in different embodiments. In some embodiments, one or more areas of steaming apparatus 120 may include thermal or heat-insulating materials, such as plastics, fibrous insulations, glass, silica, rock wool, alumina silica, mineral wool, cellular insulations, elastomer, polyolefin, polyurethane, granular insulations, or other types of insulation material known in the art. Furthermore, other components of steaming apparatus 120 may comprise other materials. Examples of different materials that could be used include, but are not limited to; metallic materials, polymer materials including plastics and/or rubbers, wooden materials, composite materials, steam-resistant materials, plastic, glass, PVC, polypropelyne as well as any other kinds of materials. Furthermore, portions of the steaming apparatus may be made of various generally flexible or inflexible materials. For example, steaming apparatus 120 can comprise a silicone rubber insulation, natural rubber or other type of synthetic or plastic insulation coating. In some embodiments, materials comprising steaming apparatus 120 may be substantially waterproof, water resistant, steam resistant, and/or substantially impermeable to steam and other gas or fluids.

A footwear customization kit can include provisions to facilitate steaming an article of footwear for modifying one or more customizable portions. As described above, in one embodiment, customization kit 140 can include steaming apparatus 120 for holding an article of footwear above or within a steaming source. Referring to the larger view provided in FIG. 3, steaming apparatus 120 is illustrated in a first state, where the first state represents the flattened configuration of the apparatus.

For purposes of this disclosure, the term "flat" or "two-dimensional material" or variants thereof is intended to encompass generally flat materials exhibiting a length and a width that are substantially greater than a thickness. In other words, a flat material may include some contours or curvature. Although flat or two-dimensional materials may have smooth or generally untextured surfaces, some two-dimensional materials will exhibit textures or other surface characteristics, such as dimpling, protrusions, ribs, or various patterns, for example. Despite the presence of surface characteristics or curvature, two-dimensional materials remain generally flat and exhibit a length and a width that are substantially greater than a thickness.

In some embodiments, steaming apparatus 120 may comprise a substantially elastic or deformable material that can be expanded and collapsed. In one embodiment, steaming apparatus 120 may be a steaming bag that encloses or partially envelops an article. In the flattened configuration, steaming apparatus 120 may have a generally flat or planar geometry, though it should be understood that there may be regions where folds exist between different sections of steaming apparatus 120 in the folded configuration, such that steaming apparatus 120 is not entirely flat. Furthermore, steaming apparatus 120 may obtain a three-dimensional geometry when erected and/or filled with a solid object or fluid, as will be described further below.

The generally flat or two-dimensional shape corresponding to the flattened configuration of steaming apparatus 120 can vary in different embodiments. In some cases, steaming apparatus 120 may have a substantially rectangular shape (shown in FIG. 3). In other cases, steaming apparatus 120 may have an approximately trapezoidal shape. Examples of other shapes for steaming apparatus 120 include, but are not limited to, rounded shapes, triangular shapes, polygonal shapes, regular shapes, irregular shapes as well as any other kinds of shapes.

In different embodiments, steaming apparatus 120 can include a steaming chamber (shown in the erected configuration of FIGS. 7-18). The steaming chamber can be defined or bounded by center portion 370 of steaming apparatus 120. In other words, center portion 370 is associated with the flattened configuration of the steaming chamber of steaming apparatus 120 in the erected configuration, which will be discussed further below. In some embodiments, center portion 370 includes a base portion 310, a footwear engaging portion 320, and a receiving end 330. In some embodiments, base portion 310 may be configured to be disposed nearer to a steaming device or steam source that is used for creating a steam environment, relative to receiving end 330. For example, in embodiments where the steaming device is a pot, base portion 310 may be proximate to or contact a bottom interior surface of the pot, while receiving end 330 is more distal from the pot. In some cases, footwear engaging portion 320 may extend in a generally upward direction from base portion 310. Furthermore, in the erected configuration (see FIGS. 7-18), footwear receiving portion 320 can extend between base portion 310 and receiving end 330.

In some embodiments, center portion 370 of steaming apparatus 120 may be joined to or framed by one or more wing portions 350. In one embodiment, a two-, three-, or four-sided structure may be formed around center portion 370 through the inclusion of wing portions 350. In some cases, center portion 370 is bounded by four wing portions 350. Wing portions 350 will be discussed further below with respect to FIG. 4.

In different embodiments, the shape of base portion 310 and/or footwear engaging portion 320 may vary. Base portion 310 may have an approximately two-dimensional shape in the flattened configuration. In some embodiments, base portion 310 comprises a folded portion of material. It should be understood that in the erected configuration (shown in FIG. 8 below) base portion 310 may be unfolded and increase in surface area. In other words, there may be two layers of base portion 310 in the flattened configuration that are stacked or folded together; these two layers can be pulled apart from each other in the erected configuration in some embodiments. In addition, the folded material of base portion 310 may include an aperture 380 disposed within base portion 310 in one embodiment, as will be discussed further below.

Figure 3:
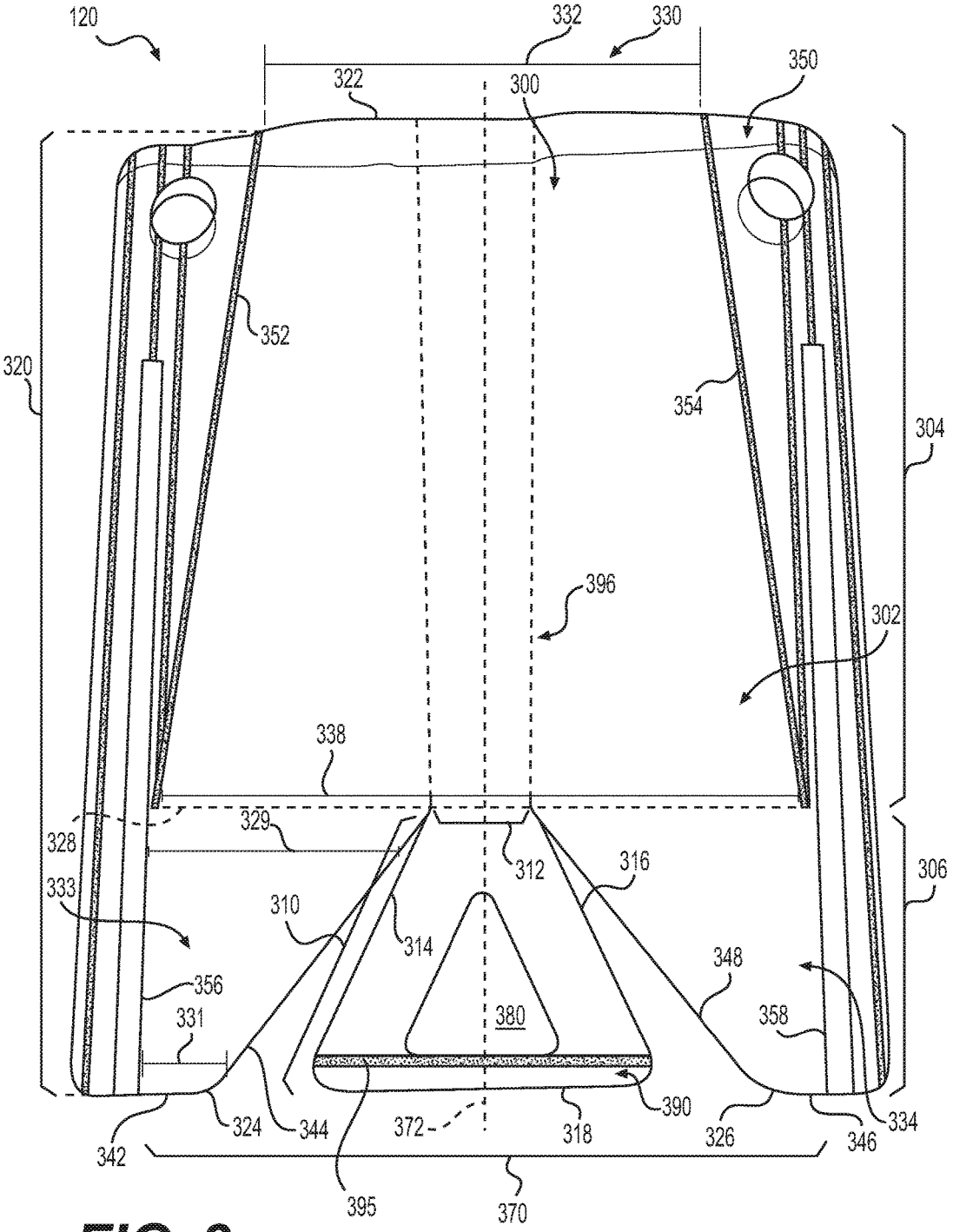
FIG. 3 is a side view of an embodiment of a steaming apparatus for an article of footwear in a flattened configuration.

Steaming apparatus 120 can include provisions for supporting an article of footwear in some embodiments. In some embodiments, a lower portion 390 of base portion 310 may be joined or attached together. In one embodiment, lower portion 390 may comprise a portion of two adjacent layers of base portion 310 that are fixedly attached. In some embodiments, lower portion 390 comprises a portion of base portion 310 that is at least partially welded together. In FIG. 3, welded region 395 extends across the width of lower portion 390. In other embodiments, welded region 395 may be larger or smaller. Thus, in some embodiments, lower portion 390 can provide a reinforced region of base portion 310 that can strengthen the structure of steaming apparatus 120.

In different embodiments, the dimensions of center portion 370 can vary. In some embodiments, footwear engaging portion 320 of center portion 370 is bounded by two or more panels 300. In the flattened configuration of steaming apparatus 120 shown in FIG. 3, a first panel 302 of footwear engaging portion 320 is illustrated. In some embodiments, footwear engaging portion 320 has three or more panels. In the present embodiment, footwear engaging portion 320 has two panels 300, stacked and joined together. Panels 300 can "sandwich" or cover two additional gusseted (folded) side panels 396, or simply "side panels," and form a substantially continuous boundary of material comprising footwear engaging portion 320. Side panels 396 are shown in dotted line in FIG. 3. Panels 300 and associated side panels 396 will be discussed further with reference to FIGS. 7 and 8 below.

In some embodiments, the geometry of first panel 302 can be curved or rounded, polygonal, and have a regular or irregular shape, as well as any other kinds of shapes. In FIG. 3, for purposes of reference, first panel 302 has an upper section 304 and a skirt section 306. The use of the terms upper section 304 and skirt section 306 are intended for purposes of description and are not intended to demarcate precise regions of first panel 320.

In some embodiments, first panel 320 may comprise a first peripheral edge 322 along the topmost edge of upper section 304, and a second peripheral edge 324 and a third peripheral edge 326 along the bottommost edges of skirt section 306. First peripheral edge 322 can be substantially linear in some embodiments, although in other embodiments, first peripheral edge 322 may include irregularities, undulations, or other curvature. Furthermore, for purposes of reference, an intermediate boundary 328 is shown in dotted line on first panel 302, where intermediate boundary 328 demarcates upper section 304 from skirt section 306. In FIG. 3, upper section 304 of first panel 302 extends from first peripheral edge 322 to intermediate boundary 328. In addition, upper section 304 of first panel 302 is bounded along a first side by a first upper edge 352, and along the opposing side by a second upper edge 354. Thus, in one embodiment, upper section 304 has a quadrilateral or trapezoidal shape. In some embodiments, first upper edge 352 and/or second upper edge 354 may be joined to a wing portion, as will be discussed with respect to FIG. 4.

In some embodiments, upper section 304 may comprise a tapered shape. In other words, upper section 304 may have a shape that narrows or decreases in width along a direction. In FIG. 3, first peripheral edge 322 has a first width 332, and intermediate boundary 328 has a second width 338. First width 332 can be larger or smaller than second width 338 in different embodiments. In one embodiment, first width 332 is smaller than second width 338. Thus, in some embodiments, first upper edge 352 may extend diagonally with respect to a central vertical axis 372 (depicted by a dotted line extending through the center of steaming apparatus 120). In addition, second upper edge 354 may extend diagonally with respect to central vertical axis 372. In one embodiment, first upper edge 352 may extend outward (i.e., away from central vertical axis 372) as it extends from first peripheral edge 322 to intermediate boundary 328. Similarly, in some embodiments, second upper edge 354 may extend outward (i.e., away from central vertical axis 372) as it extends from first peripheral edge 322 to intermediate boundary 328. Furthermore, in some embodiments, first panel 320 can have a substantially symmetrical shape with respect to central vertical axis 372. In other embodiments, steaming apparatus 120 is substantially symmetrical about a longitudinal axis in the flattened configuration.

Additionally, in some embodiments, skirt section 306 of first panel 302 can comprise two substantially similar or symmetrical portions, including a first skirt portion 333 and a second skirt portion 334. In one embodiment, each skirt portion extends downward from intermediate boundary 328. In some embodiments, first skirt portion 333 has a first skirt edge 356 extending downward from first upper edge 352, and second skirt portion edge 334 has a second skirt edge 358 extending downward from second upper edge 354. In some embodiments, first skirt edge 356 and/or second skirt edge 358 may be joined to a wing portion, as will be discussed with respect to FIG. 4.

Furthermore, it can be seen in FIG. 3 that first skirt portion 333 is bounded along an outer edge by second peripheral edge 324, and second skirt portion 334 is bounded along an outer edge by third peripheral edge 326. For purposes of reference, second peripheral edge 324 comprises a first lower edge 342 extending in a direction perpendicular to central vertical axis 372, and a second lower edge 344 extending in a direction diagonal with respect to central vertical axis 372. Similarly, third peripheral edge 326 comprises a third lower edge 346 extending in a direction perpendicular to central vertical axis 372, and a fourth lower edge 348 extending in a direction diagonal with respect to central vertical axis 372.

In some embodiments, first skirt portion 333 and/or second skirt portion 334 may have a tapered shape. In other words, first skirt portion 333 and/or second skirt portion 334 may have a shape that narrows or decreases in width along a direction. For example, in FIG. 3, a first segment of first skirt portion 333 has a third width 329, and a second segment of first skirt portion 333 has a fourth width 331, where the first segment is nearer to intermediate boundary 328 than the second segment. Third width 329 can be larger or smaller than fourth width 331 in different embodiments. In one embodiment, third width 329 is larger than fourth width 331.

Thus, in one embodiment, second lower edge 344 may extend outward (i.e., away from central vertical axis 372) as it extends from intermediate boundary 328 in a downward direction toward first lower edge 342, forming a tapered shape. In some embodiments, second skirt portion 334 can have a substantially similar shape as first skirt portion 333. Thus, in one embodiment, first skirt portion 333 and/or second skirt portion 334 can have a quadrilateral or specifically, a trapezoidal, shape.

In different embodiments, portions of first panel 302 may be joined to base portion 310. Base portion 310 can have different shapes in some embodiments. Some examples of different shapes for base portion 310 and/or aperture 380 include, but are not limited to, rounded shapes, rectangular shapes, quadrilateral shapes, trapezoidal shapes, polygonal shapes, regular shapes, irregular shapes as well as any other kind of shapes. In the current embodiment, base portion 310 has an approximately triangular shape with a blunted apex, forming a generally trapezoidal shape. In other words, base portion 310 comprises four sides, including a first base side 312, a second base side 314, a third base side 316, and a fourth base side 318. In some embodiments, first base side 312 and fourth base side 318 may be substantially parallel, while second base side 314 and third base side 316 are diagonal with respect to central vertical axis 372. Furthermore, it should be understood first base side 312 is identified for reference purposes only, and identifies the portion of intermediate boundary 372 associated with the upper edge of base portion 310. In other words, first base side 312 may be integrally formed or continuous with the remainder of first panel 302. Fourth base side 318 may be associated with a peripheral edge of lower portion 390, described above.

In addition, while lower portion 390 may comprise a seam or a region of fixed attachment (such as welded region 395), in some embodiments, the remainder of base portion 310 can be unattached. In other words, second base side 314 may comprise the adjacent unjoined (stacked) edges of a two-layered base portion, and third base side 316 may comprise the adjacent unjoined (stacked) edges of the two-layered base portion. The discontinuity of the two peripheral edges comprising second base side 314 and third base side 316 of base portion 310 may allow base portion 310 to unfold, and will be discussed further with respect to the erected configuration below.

Furthermore, the arrangement of base portion 310 can vary in different embodiments. In some embodiments, base portion 310 can be positioned or dimensioned such that it extends lower (further downward) than skirt section 306. In the embodiment of FIG. 3, however, the peripheral lowermost edge of base portion 310 (identified by fourth base side 318) and the peripheral lowermost edges of skirt section 306 (i.e., first lower edge 342 and third lower edge 346) are substantially aligned.

Figure 4:
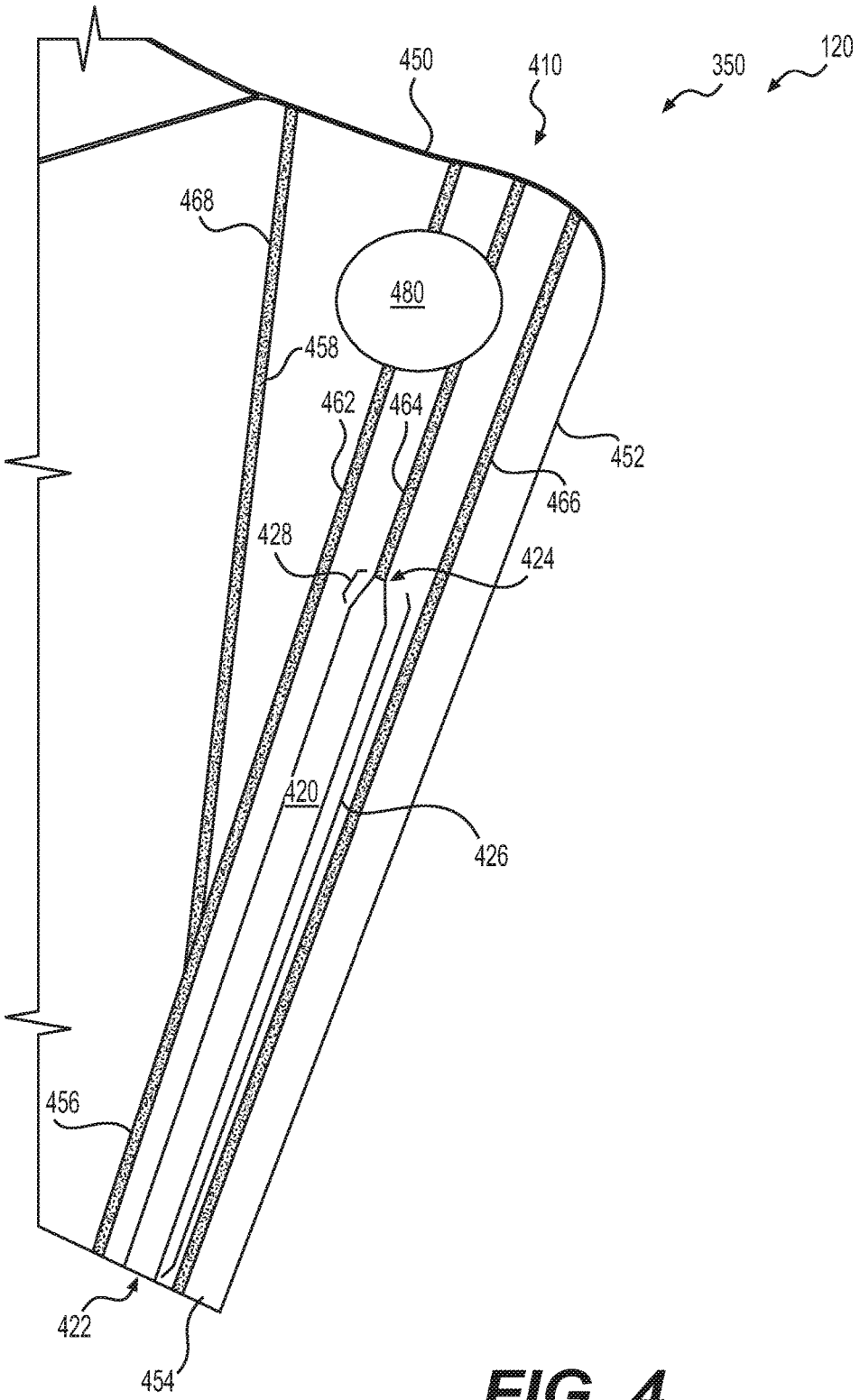
FIG. 4 is a cutaway view of an embodiment of a wing portion for a steaming apparatus.
Figure 5:
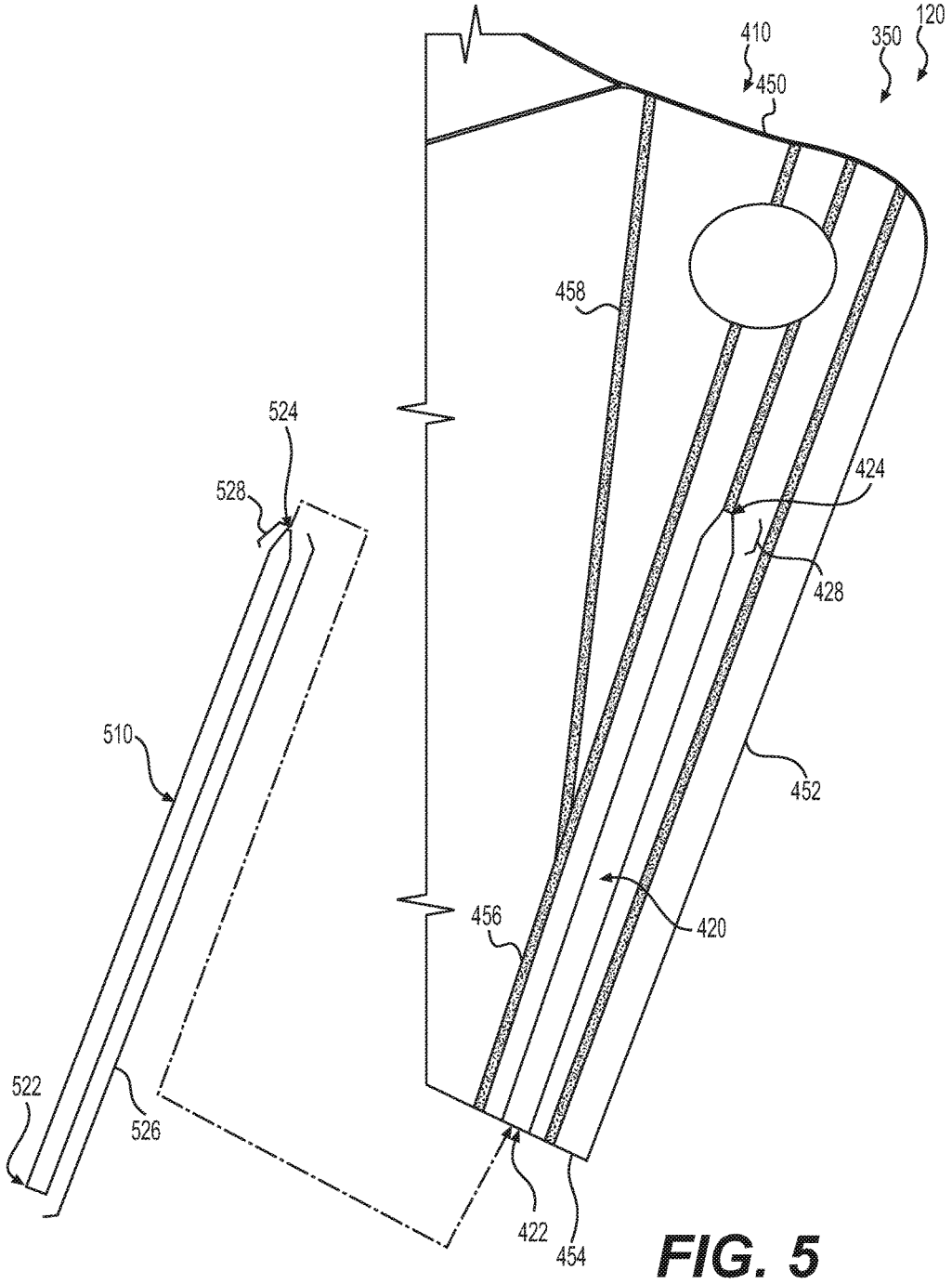
FIG. 5 is a cutaway view of an embodiment of a wing portion for a steaming apparatus and an elongated element.
Figure 6:
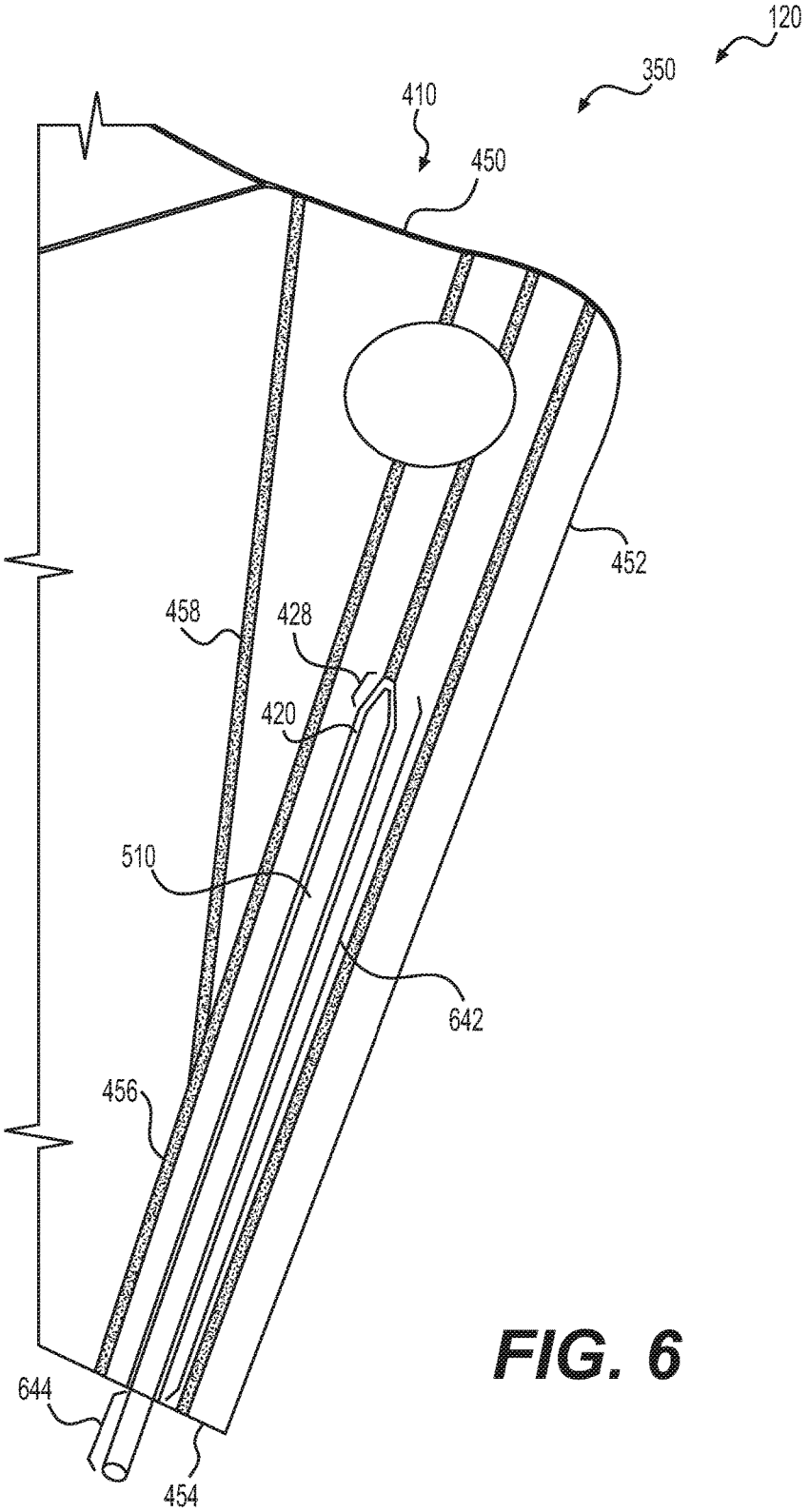
FIG. 6 is a cutaway view of an embodiment of a wing portion for a steaming apparatus and an elongated element.

In different embodiments, steaming apparatus 120 may include provisions for standing, erecting, or otherwise positioning the steaming apparatus on a surface. As noted earlier, in some embodiments, steaming apparatus 120 can include one or more wing portions 350. FIGS. 4-6 depict a cutaway view of a portion of steaming apparatus 120 that includes a first wing portion 410. While only first wing portion 410 will be described in detail herein, it should be understood that the features, characteristics, and structural properties of first wing portion 410 may be applicable to other wing portions 350 of steaming apparatus 120.

In FIG. 4, first wing portion 410 is illustrated, joined, or fixedly attached to an edge of center portion 370. The shape of first wing portion 410 can vary, including, but not limited to, shapes that are rectangular, triangular, pentagonal, polygonal, and have a regular or irregular shape, as well as any other kinds of shapes. In FIG. 4, first wing portion 410 has a generally five-sided shape, including a first side 450, a second side 452, a third side 454, a fourth side 456, and a fifth side 458. As noted above, in some embodiments, some portions of first wing portion 410 may be joined to one or more panels of center portion 370. In embodiments where first wing portion 410 is disposed adjacent to first panel 310 (see FIG. 3), fifth side 458 may correspond to second upper edge 354 (see FIG. 3), and/or fourth side 456 may correspond to second skirt edge 358 (see FIG. 3). In some embodiments, fifth side 458 may correspond to an edge or side of two panels of center portion 370, as will be described further below.

In some embodiments, steaming apparatus 120 can include additional provisions for facilitating ease of use. In different embodiments, there may be provisions for facilitating contact between steaming apparatus 120 and a user during use. In some embodiments, steaming apparatus 120 can include one or more holes that are easily grasped by a user. For example, steaming apparatus 120 can include holes configured for grasping when steaming apparatus 120 is in fluid communication with a steam environment or other heat source. In FIG. 4, a first grasping hole 480 is formed in first wing portion 410. First grasping hole 480 can be located anywhere through the thickness of first wing portion 410. In one embodiment, first grasping hole 480 is located proximal a curved corner formed between first side 450 and second side 452.

In FIG. 4, first grasping hole 480 is substantially circular in shape. However, in other embodiments, a grasping hole can vary in shape, and include rectangular, triangular, polygonal or other regular or irregular shapes. First grasping hole 480 is an opening through the thickness of first wing portion 410, sized and dimensioned to allow a typical adult user to insert at least a part of a finger. In some embodiments, a user may use first grasping hole 480 to encircle a portion of first wing portion 410 and press the tip of a forefinger and the tip of a thumb together. This can allow a user to more easily and comfortably lift or reposition steaming apparatus 120 while steaming apparatus 120 is exposed to different temperatures.

First wing portion 410 generally comprises one or more layers of material that are more rigid or resistant to deformation relative to center portion 370. In some embodiments, first wing portion 410 can comprise two adjacent or stacked layers of material. In one embodiment, the material is substantially similar to the material of center portion 370 but is treated in a manner that increases the rigidity of the region. In some embodiments, at least some portions of the two layers are fixedly attached or adhered together, forming a thicker and more resilient and rigid portion.

In addition, in some embodiments, first wing portion 410 can include provisions to provide greater stability and strength to the steaming apparatus. For example, in some embodiments, some regions of first wing portion 410 can include reinforced zones. In FIG. 4, first wing portion 410 has a first reinforced zone 462, a second reinforced zone 464, a third reinforced zone 466, and a fourth reinforced zone 468. Reinforced zones can comprise regions of a wing portion that are adhered together or strengthened by additional bonding techniques. In one embodiment, reinforced zones can comprise portions of first wing portion 410 that have been welded. In addition, the arrangement and orientation of the reinforced zones can be selected to provide stability in specific regions of bending. For example, in FIG. 4, first reinforced zone 462, second reinforced zone 464, and third reinforced zone 466 extend in a direction generally parallel to the vertically oriented second side 452, increasing the ability of first wing portion 410 to resist bending in directions that are non-parallel to second side 452. Furthermore, fourth reinforced zone 468 corresponds to fifth side 458, buttressing the region of attachment to center portion 370. In some cases, a reinforced zone may comprise discontinuous segments along first wing portion 410. For example, in FIG. 4, first reinforced zone 462 and second reinforced zone 464 begin at first side 450 and extend downward. However, both first reinforced zone 462 and second reinforced zone 464 are broken or interrupted across the region corresponding to first grasping hole 480.

In addition, in some embodiments, first wing portion 410 can include provisions for receiving a supporting element. In the embodiment of FIG. 4, a first channel 420 is formed within the two adjacent layers comprising first wing portion 410. In other words, while the two adjacent layers are joined together throughout a substantial majority of first wing portion 410, there may be a portion of first wing portion 410 where the two layers are spaced apart. In one embodiment, first channel 420 defines a pocket, recess, opening, or tunnel within the two adjacent layers comprising first wing portion 410. While only first channel 420 is discussed in detail herein, in different embodiments, each wing portion may include a channel. Furthermore, in some embodiments, two or more of the channels formed in steaming apparatus 120 may be substantially similar. Thus, in different embodiments, one channel may be configured to receive any of the elongated elements, in cases where the elongated elements have similar dimensions. However, in other embodiments, two or more channels may differ, and may each be sized and dimensioned to receive two differently sized or dimensioned elongated elements respectively.

Referring to FIG. 4, first channel 420 is a substantially elongated blind-hole channel or blind-hole opening through first wing portion 410. In other words, first channel 420 is open along one end, and is closed along its opposing end. In FIG. 4, first channel 420 has a first length 426 that extends between an insertion end 422 (formed along third side 454) and a first tip end 424 formed within an intermediate portion of first wing portion 410. In some embodiments, the width of first channel 420 is substantially constant from insertion end 422 to first tip end 424. However, in other embodiments, first tip end 424 may include a first tapered region 428 with a tapering width, where the width gradually decreases in the direction toward first tip end 424 throughout first tapered region 428.

In some embodiments, the outer dimensions of first channel 420 are such that an elongated element (see elongated elements 160 in FIGS. 1 and 2) will fit snugly into the tunnel formed by the outer surface of the channel. In other words, an elongated element can be configured to be secured within, and/or be received and held by a channel in one embodiment. In other embodiments, other securing mechanisms may be used to securely position an elongated element with steaming apparatus 120.

As shown in FIG. 5, a first elongated element 510 is shown next to first wing portion 410. First elongated element 510 can comprise a variety of cross-sectional horizontal shapes in different embodiments, including circular, square, polygonal, or other regular or irregular cross-sectional shapes. In FIG. 5, first elongated element 510 has a substantially round horizontal cross-sectional shape over its length. Thus, first elongated element 510 can be seen to have a second length 526 that extends between a free end or base end 522 and a second tip end 524. In some embodiments, the width (or diameter) of first elongated element 510 is substantially constant from base end 522 and second tip end 524. However, in other embodiments, second tip end 524 may include a second tapered region 528 of tapering width (or diameter), such that the thickness of first elongated element 510 gradually decreases in the direction toward second tip end 524 in second tapered region 528.

In some embodiments, the majority of the length of first elongated element 510 can be sized and dimensioned to be at least partially snugly inserted into the recess associated with first channel 420. In some embodiments, second length 526 is substantially similar to first length 426. In the embodiments of FIGS. 4-6, second length 526 is substantially longer than first length 426. Furthermore, in one embodiment, a maximum diameter of first elongated element 510 is substantially similar to (or slightly less than) the diameter associated with the channel formed in first wing portion 410. Furthermore, in cases where first elongated element 510 has second tapered region 528, the dimensions of second tapered region 528 may generally correspond to (or be slightly less than) the dimensions of an interior of first tapered region 428.

In the sequence shown in FIGS. 5 and 6, first elongated element 510 is inserted into insertion end 422 of first channel 410. It can be see that once first elongated element 510 is pushed into first channel 410, it extends through and fills the substantial entirety of the interior of first channel 410. In some embodiments, when first elongated element 510 is fully inserted into first channel 410, second tapered region 528 is snugly received within first tapered region 428, as shown in FIG. 6.

Furthermore, in some embodiments, there may be a portion of first elongated element 510 that remains exposed. In other words, first elongated element 510 has an inserted segment 642 that is received by first channel 410, and an exposed segment 644 that remains outside of first channel 410. In some embodiments, the length of exposed segment 644 represents the difference in length between first length 426 and second length 526. In addition, exposed segment 644 includes base end 522, such that base end 522 remains outside of first channel 410 when first elongated element 510 is received by first channel 410. Base end 522 will be discussed further with respect to FIGS. 11 and 12.

Figure 7:
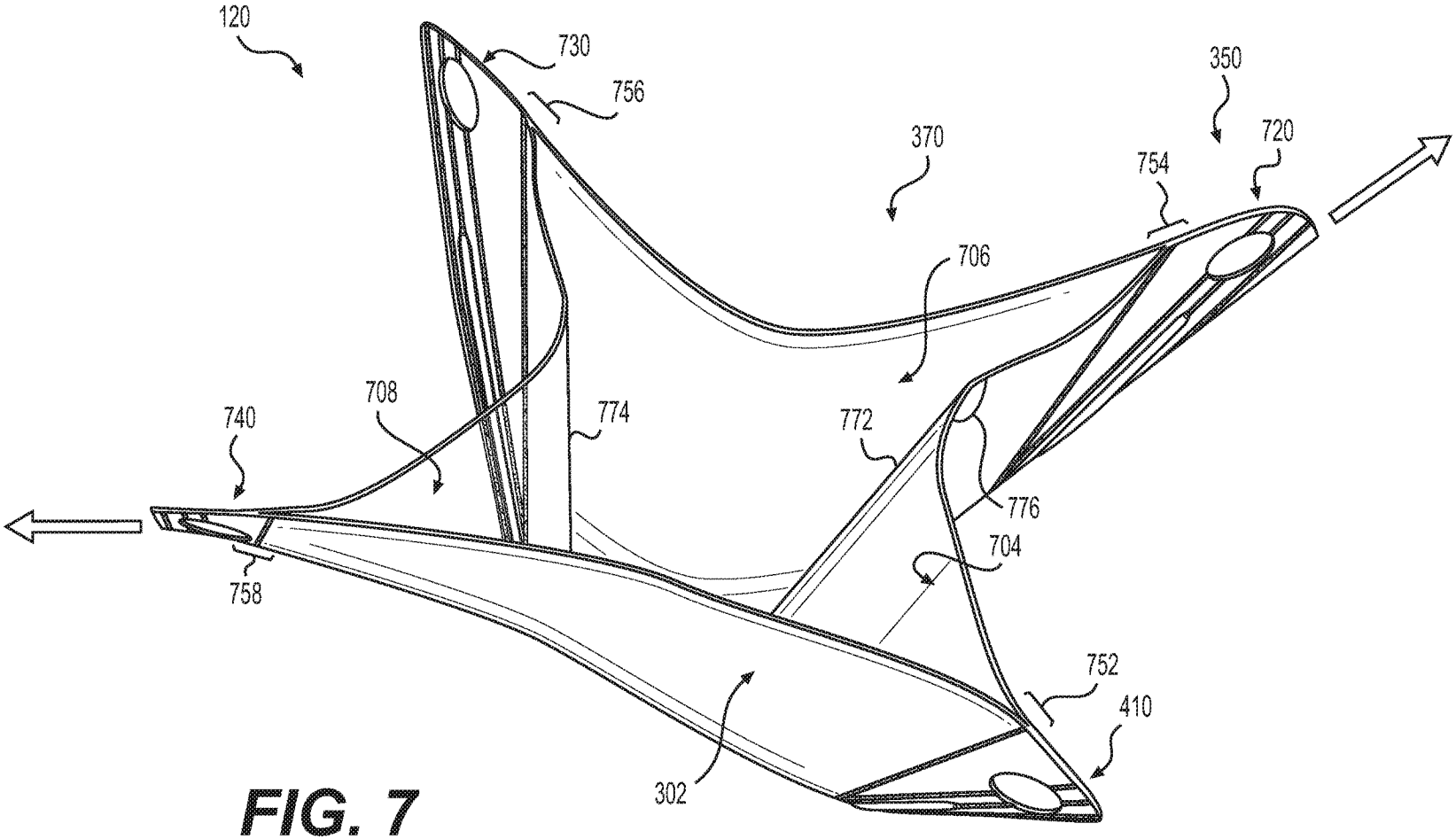
FIG. 7 is an isometric view of an embodiment of a steaming apparatus being expanded.

Referring now to FIG. 7, an isometric top view of an embodiment of the erecting process for steaming apparatus 120 is depicted. FIG. 7 also provides a clearer view of wing portions 350 that adjoin center portion 370. In one embodiment, steaming apparatus 120 has four wing portions, including first wing portion 410, a second wing portion 720, a third wing portion 730, and a fourth wing portion 740. Furthermore, as noted above, in some embodiments, footwear engaging portion 320 of center portion 370 can comprise a series of panels, including first panel 302 and a second panel 706. In different embodiments, first panel 302 and second panel 706 are substantially similar, and the description of first panel 302 provided above with respect to FIG. 3 may apply to third panel 706. In addition, first panel 302 and second panel 706 are joined along their outer edges to a first side panel 704 and a second side panel 708.

Furthermore, in some embodiments, first side panel 704 and second side panel 708 may be substantially similar. In some embodiments, the side panels may be gusseted. A gusseted side panel as used herein and in the claims means a folded or creased side panel that is joined to a front and a back panel (i.e., first panel 302 and second panel 706). The gusseted panel may include a folding crease that enables the side panel to more easily transition the steaming apparatus between the flattened configuration and the erected configuration. In FIG. 7, first side panel 704 has a first folding crease 772 and second side panel 708 has a second folding crease 774, where each folding crease extends along a midline of the side panel. The dimensions of the side panels are such that when folded inward they are enclosed or covered between the layers of first panel 302 and second panel 706. Further details regarding the side panels will be discussed below with respect to FIG. 8.

Figure 8:
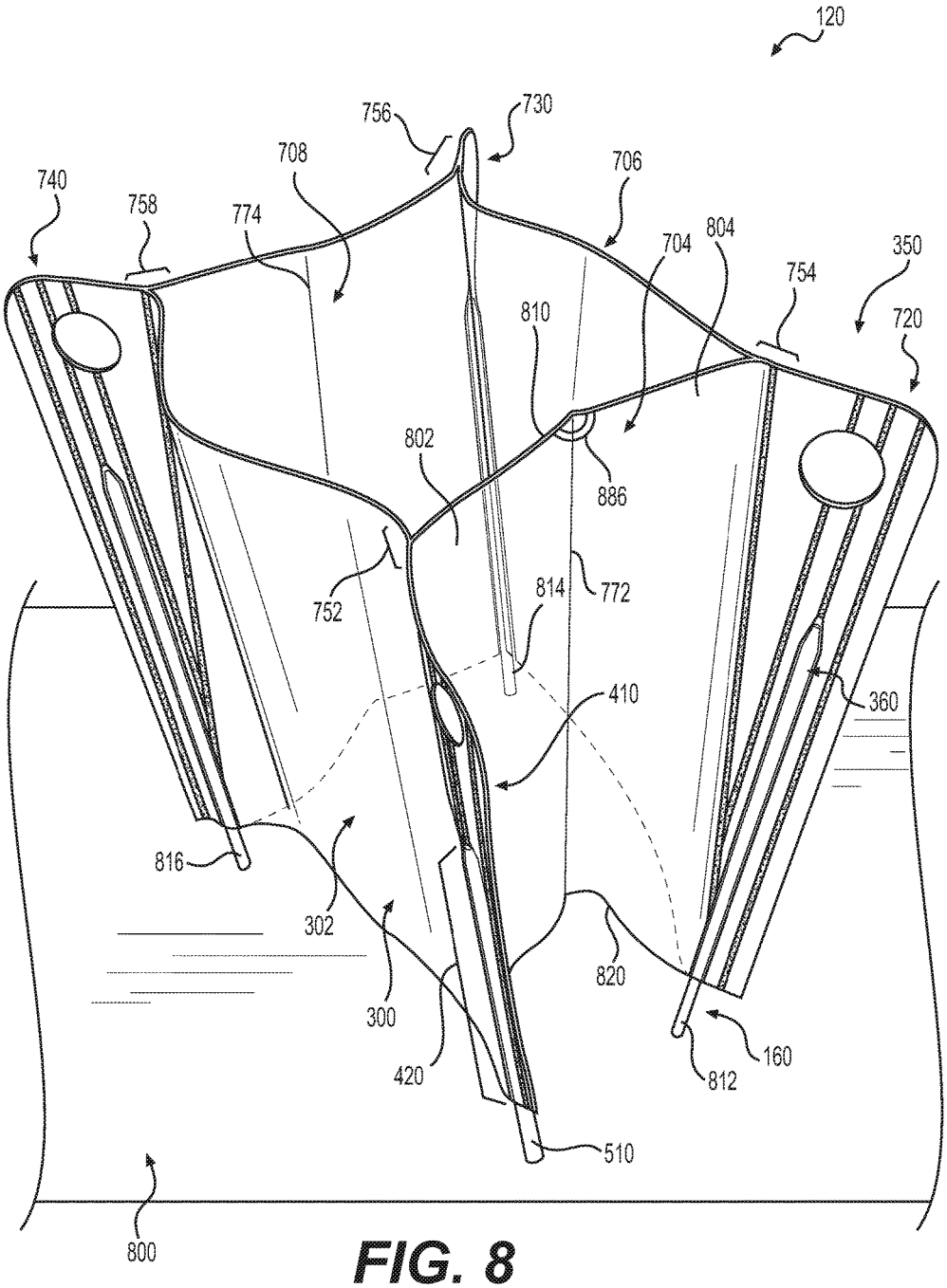
FIG. 8 is an isometric view of an embodiment of a steaming apparatus in an erected configuration.

In FIGS. 7 and 8, it can be seen that the various sections of the gusseted side panels are not affixed to each other, but are each affixed along their respective edges to an edge of first panel 302 and an edge of second panel 706. As a result, in different embodiments, steaming apparatus 120 can comprise one or more "corner portions," where each corner portion represents a region of intersection between an edge of a panel, an edge of a side panel, and a wing portion. In FIGS. 7 and 8, a first corner portion 752, a second corner portion 754, a third corner portion 756, and a fourth corner portion 758 are included in steaming apparatus 120. First corner portion 752 includes the intersection region of first panel 302, first side panel 704, and first wing portion 410. Second corner portion 754 includes the intersection region of first side panel 704, second panel 706, and second wing portion 720. Third corner portion 756 includes the intersection region of second panel 706, second side panel 708, and third wing portion 730. Fourth corner portion 758 includes the intersection region of second side panel 708, first panel 302, and fourth wing portion 740. Thus, in some embodiments, each wing portion is associated with a "corner portion" as it joins to edges of a panel and a side panel that extend outward from center portion 370.

When a user is ready to utilize steaming apparatus 120, it may initially be in the first state, or flattened configuration, as shown in FIG. 3. In different embodiments, steaming apparatus 120 may include provisions to facilitate the transition of steaming apparatus 120 from the flattened configuration to an erected configuration (i.e., to "open" or expand the steaming apparatus and provide access to a steaming chamber). In some embodiments, steaming apparatus 120 provides a quick and convenient arrangement for opening steaming apparatus 120 and expanding the steaming chamber. As shown in FIG. 7, in one embodiment, diagonally opposite corners of steaming apparatus 120 may be grasped and pulled apart (schematically represented in FIG. 7 by two arrows). Thus, in some cases, a user may grasp a first wing portion and a second wing portion of a steaming apparatus, pull the first wing portion in a first direction and pull the second wing portion in a second direction (where the first direction is substantially opposite to the second direction), and form the expanded steaming chamber. In some cases, the steaming apparatus can be erected on a surface. In FIG. 7, the second wing portion is selected to be disposed diagonally across from the first wing portion (demonstrated when the steaming chamber is in the erected configuration).

In other words, in one embodiment, the process of pulling apart diagonally opposite corners of the steaming apparatus may substantially or entirely transition steaming apparatus 120 from the flattened configuration to the erected configuration. In some embodiments, the opening of the steaming chamber can be accomplished in a single step. In some other embodiments, to more fully open steaming apparatus 120, the two remaining diagonally opposite corners can then be also pulled outward in a similar manner. In other embodiments, a user may also arrange a bottom end of one or more of the elongated elements (see FIG. 6) to contact a surface in order to position or erect the steaming apparatus on the surface.

FIG. 8 is an isometric view of an embodiment of the erected configuration or second state of steaming apparatus 120. It can be seen that in the erected configuration, while first panel 302 and second panel 706 remain generally flat (similar to their geometry in the folded configuration), first side panel 704 and second side panel 708 have transitioned from a substantially (or nearly entirely) folded structure to a partially folded or "bent" structure. In the embodiment of FIG. 8, the bend that is depicted along the length of each side panel corresponds to the folding crease of the side panel. Thus, in FIG. 8, first folding crease 772 of first side panel 704 is in the expanded (or substantially unfolded) state, such that a first face 802 and a second face 804 of first side panel 704 no longer directly face or contact one another. For purposes of reference, first face 802 and second face 804 are associated with two sides of first side panel 704 demarcated by first folding crease 772. Furthermore, while only first side panel 704 will be described in detail herein, it should be understood that the features, characteristics, and structural properties of first side panel 704 may be applicable to other side panels (e.g., second side panel 708) of steaming apparatus 120.

In some embodiments, first side panel 704 has an upper peripheral edge 810 that bends slightly toward the middle of the erected configuration, where first folding crease 772 begins. In addition, first side panel 704 has a third length extending from upper peripheral edge 810 to a lower peripheral edge 820. In some embodiments, lower peripheral edge 820 may be substantially more bent or folded than upper peripheral edge 810 in the erected configuration. In one embodiment, as will be shown below with respect to FIG. 10, lower peripheral edge 820 can bend sharply inward toward the base portion of steaming apparatus 120 in the erected configuration.

In addition, during the transition between the folded configuration (see FIG. 3) and the erected configuration of FIG. 8, the angle associated with a folding crease formed in the side panel may change. In some embodiments, the angle may increase as steaming apparatus 120 is expanded. In particular, in one embodiment, the bending angle in the region of first side panel 704 proximate to upper peripheral edge 810 may increase in magnitude. For example, in FIG. 7, first folding crease 772 is associated with a first angle 776, and in FIG. 8, first folding crease 772 is associated with a second angle 886, where second angle 886 is substantially greater than first angle 776.

In some embodiments, the erected configuration of steaming apparatus 120 may provide a substantially stable structure. In other words, steaming apparatus 120 may be able to stand independently on a surface in some embodiments. For example, as shown in FIG. 8, first elongated element 510 extends from first channel 420 and the base end of first elongated element 510 is in contact with a surface 800. The remaining elongated elements are depicted as inserted within channels 360 formed in each of the wing portions of steaming apparatus 120 in FIG. 8. Thus, a second elongated element 812, a third elongated element 814, and a fourth elongated element 816 are shown extending downward from steaming apparatus 120. In some embodiments, each elongated element is associated with a bottom of a corner portion of steaming apparatus 120. In one embodiment, this arrangement can allow steaming apparatus 120 to stand on surface 800 in the erected state. Furthermore, elongated elements 160 allow the majority of steaming apparatus and the steaming chamber to be raised above surface 800.

Figure 9:
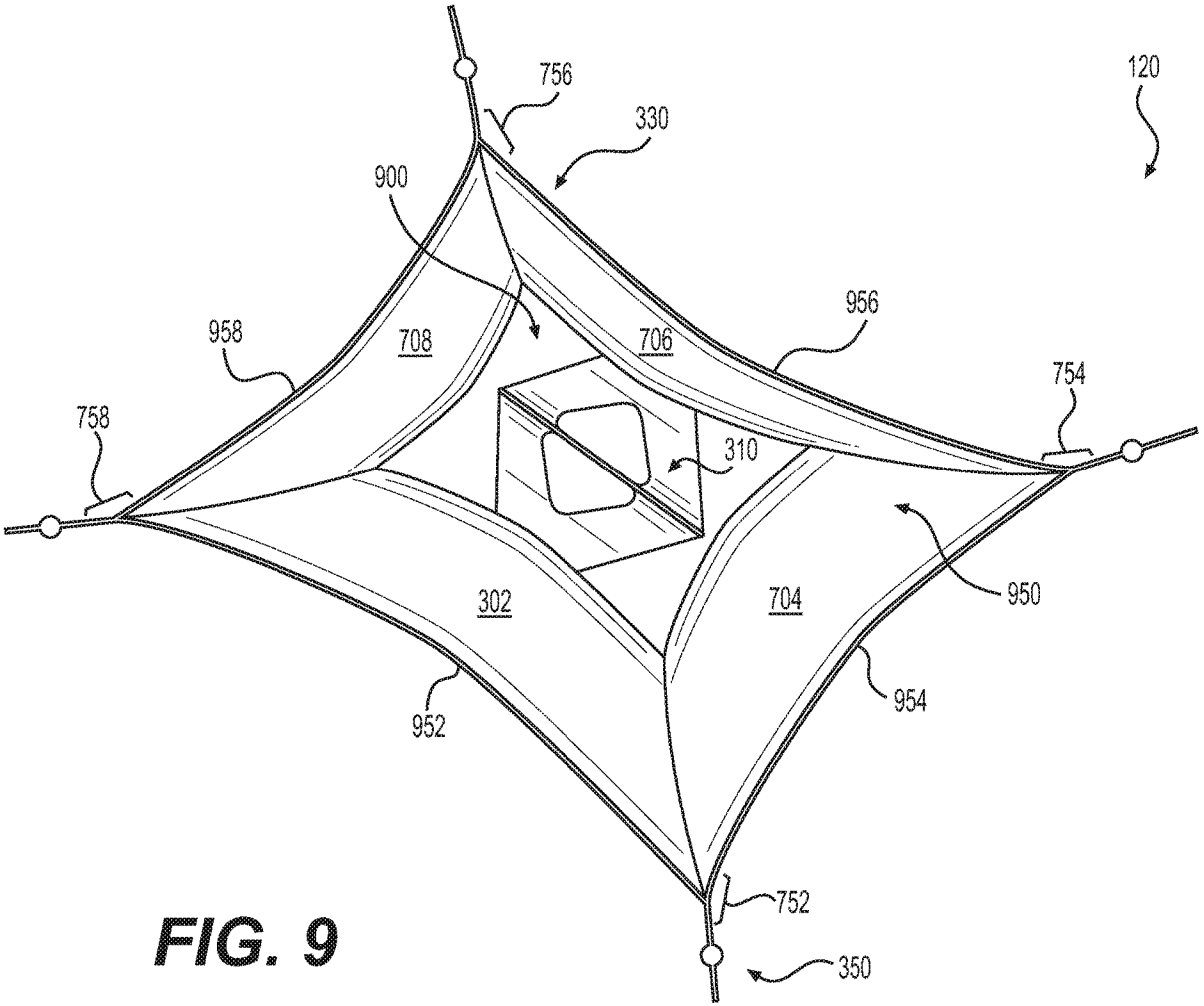
FIG. 9 is a top-down view of an embodiment of a steaming apparatus in the erected configuration.

In the top-down view of FIG. 9, receiving end 330 of steaming apparatus 120 is illustrated in the erected configuration. In some embodiments, receiving end 330 may, in the flattened configuration, initially comprise a region of substantial contact between edges of first panel 302 and second panel 706, between edges of first panel 302 and first side panel 704, between edges of second panel 706 and first side panel 704, between edges of first panel 302 and second side panel 708, and/or between edges of second panel 706 and second side panel 708. In other words, receiving end 330 may be a substantially closed or collapsed region in the flattened configuration. However, as steaming apparatus 120 is pulled open and erected, it can be seen that receiving end 330 becomes associated with an opening 950. Opening 950 can be bounded by a first outer edge 952, a second outer edge 954, a third outer edge 956, and a fourth outer edge 958 in some embodiments. In FIG. 9, first outer edge 952 corresponds to a peripheral edge of first panel 302, second outer edge 954 corresponds to a peripheral edge of first side panel 704, third outer edge 956 corresponds to a peripheral edge of second panel 706, and fourth outer edge 958 corresponds to a peripheral edge of second side panel 708. In addition, in one embodiment, each of the four edges is joined to an adjacent edge along a corner portion (see FIG. 7). In some embodiments, opening 950 and/or the resultant steaming chamber 900 may be sized and dimensioned to receive an article of footwear. Thus, in different embodiments, the perimeter associated with opening 950 may be larger than a perimeter associated with the largest vertical cross section of an article of footwear that is configured for use with steaming apparatus 120.

Opening 950 can lead to and/or facilitate fluid communication with steaming chamber 900 in some embodiments. Thus, in some embodiments, once opening 950 is formed, it can be seen that steaming chamber 900 may be accessible within steaming apparatus 120. In one embodiment, steaming chamber 900 comprises a substantially continuous and hollow tube within steaming apparatus 120. In FIG. 9, steaming chamber 900 is bounded by an interior-facing surface of each of first panel 302, first side panel 704, second panel 706, and second side panel 708, as well as base portion 310. It should be understood that steaming chamber 900 does not comprise a fully bounded or enclosed chamber, and can include one or more openings, as will be discussed further below.

In different embodiments, steaming chamber 900 can comprise various shapes. In some embodiments, steaming chamber 900 and opening 950 (i.e., when receiving end 330 is in the erected configuration) has a horizontal cross-sectional shape that is substantially rectangular, or has a curved rectangular shape, as shown in FIG. 9. However, in other embodiments, the horizontal cross-sectional shape of steaming chamber 900 may be round, elliptical, oblong, square, triangular, trapezoidal, pentagonal, polygonal, or any other regular or irregular shape. Furthermore, it should be understood that the description of the shape of the steaming chamber is an approximation, as steaming chamber 900 can include irregularities, pointed or bent regions, and other surface contours and curvature that can affect the shape of the opening and the steaming chamber. In particular, once an article is placed within steaming apparatus 120, the shape of steaming chamber 900 may be deformed or otherwise modified as the positioning of the article exerts a force along one or more of the interior surfaces of the steaming chamber.

Figure 10:
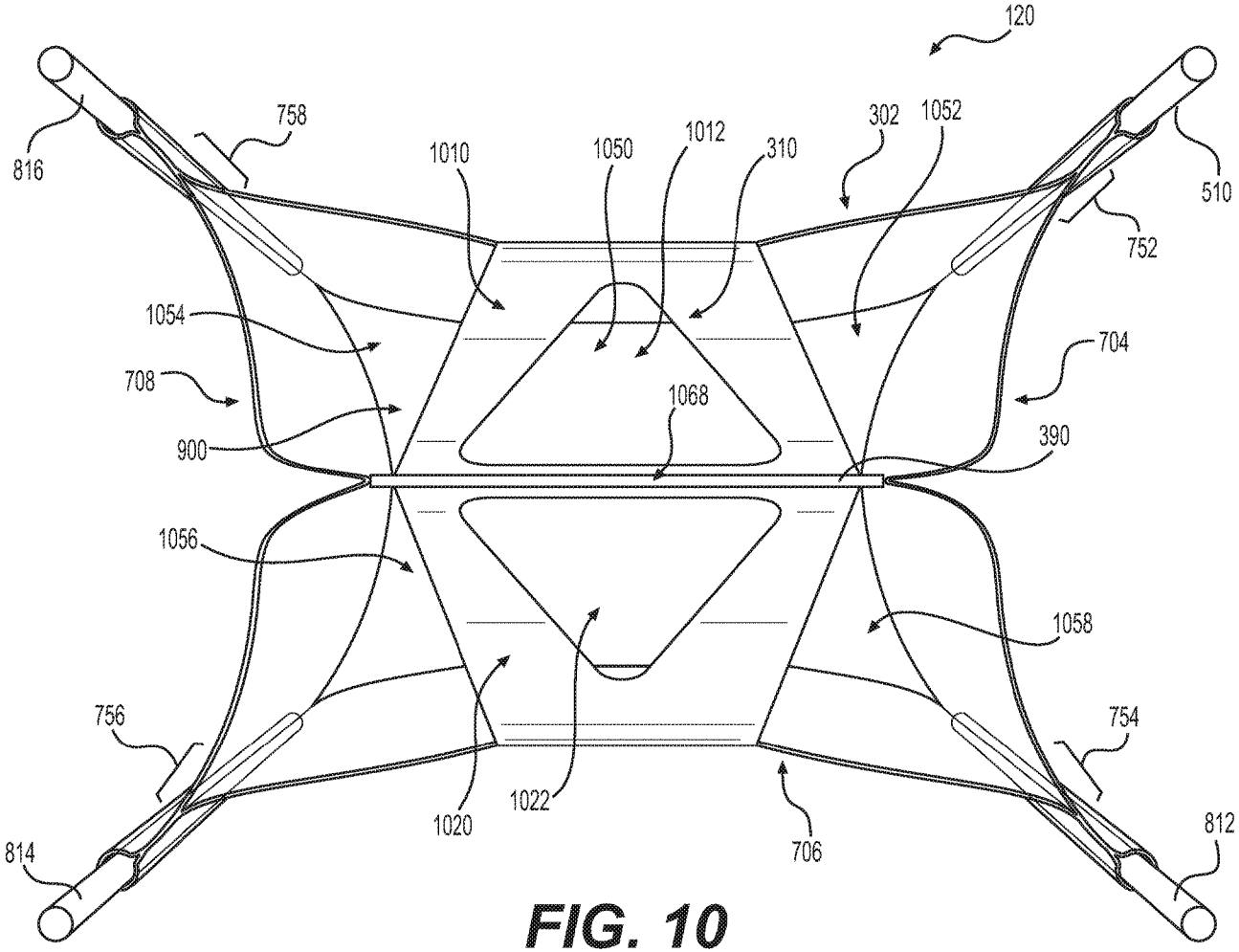
FIG. 10 is a bottom-up view of an embodiment of a steaming apparatus in the erected configuration.

In the bottom-up view of FIG. 10, base portion 310 of steaming apparatus 120 is illustrated in the erected configuration. In some embodiments, base portion 310 may be a substantially folded or collapsed region in the flattened configuration. However, as steaming apparatus 120 is pulled open and erected, it can be seen that the surface area of base portion 310 expands and comprises a first base portion 1010 and a second base portion 1020. In other words, when base portion 310 is in the folded configuration, base portion 310 may initially comprise a region of substantial contact between an interior-facing surface of first base portion 1010 and an interior-facing surface of second base portion 1020. In some embodiments, first base portion 1010 and second base portion 1020 are substantially similar in size and shape. Thus, in some cases, base portion 310 can comprise two substantially symmetrical portions that are joined to lower portion 390. In FIG. 10, first base portion 1010 and second base portion 1020 are joined along one end corresponding to an edge of lower portion 390.

In FIG. 10, first base portion 1010 has a substantially trapezoidal shape, and second base portion 1020 has a substantially trapezoidal shape. In FIG. 10, base portion 310 comprises a six-sided shape joined to the quadrilaterally shaped lower portion, where lower portion 390 is joined to the six-sided shape along the same region where first base portion 1010 is joined to second base portion 1020. In some embodiments, the six-sided shape comprising first base portion 1010 and second base portion 1020 can be hexagonal. However, in other embodiments, the shape resulting from the expansion of base portion 310 may be rectangular, pentagonal, polygonal, or any other regular or irregular shape. Thus, in different embodiments, the overall shape of base portion 310 can differ in the erected configuration relative to the flattened configuration.

In some embodiments, base portion 310 and other portions of the lower peripheral edges associated with each of first panel 302, second panel 706, first side panel 704, and second side panel 708 can correspond to a bottom of steaming chamber 900. In addition, in different embodiments, steaming chamber 900 includes provisions for permitting the entry or movement of steam into steaming chamber 900. In FIG. 10, it can be seen that the bottom of steaming chamber 900 can include a plurality of apertures 1050. Specifically, as noted earlier, base portion 310 includes aperture 380 (see FIG. 3). In the flattened configuration, aperture 380 was substantially continuous and was formed through the thickness of the two stacked or aligned layers comprising first base portion 1010 and second base portion 1020. However, in the erected configuration shown in FIG. 10, where base portion 310 has expanded in area and unfolded into two distinct base portions, aperture 380 may separate and form two apertures. In other words, first base portion 1010 can include a first aperture 1012, and second base portion 1020 can include a second aperture 1022.

Furthermore, in some embodiments, the arrangement of one or more of each of first corner portion 752, second corner portion 754, third corner portion 756, and fourth corner portion 758 can provide steaming chamber 900 with additional plurality of apertures 1050. For example, as shown in FIG. 10, extending from first corner portion 752 to an edge of first base portion 1010 is a third aperture 1052, extending from second corner portion 754 to an edge of first base portion 1010 is a fourth aperture 1054, extending from third corner portion 756 to an edge of second base portion 1020 is a fifth aperture 1056, and extending from fourth corner portion 758 to an edge of second base portion 1020 is a sixth aperture 1058. In some embodiments, one or more apertures can comprise a substantially three-sided shape. However, in other embodiments, each aperture may include other shapes and/or a fewer or greater number of sides, and/or the size of an aperture can vary from that depicted in the Figures. In different embodiments, each aperture can lead to (i.e., facilitate fluid communication with) steaming chamber 900. Thus, in some embodiments, a steam source may move or travel into steaming chamber 900 via apertures that are formed along the bottom of steaming apparatus 120.

In addition, FIG. 10 provides a view of an embodiment of the arrangement of wing portions in the erected configuration from below. It can be seen that, in some embodiments, wing portions can extend outward from a central point 1068. In other words, in one embodiment, one or more wing portions can extend radially outward from the steaming chamber when the steaming bag is erected.

Referring now to FIGS. 11-14, a sequence of figures depicting variations of a method of inserting an article of footwear into steaming apparatus 120 is provided. For purposes of clarity, the method is only illustrated using first article 101; however, it will be understood that similar steps may be repeated to customize a second article of footwear. Thus, it should be understood that other embodiments may incorporate a corresponding article of footwear (e.g., second article 102 of FIG. 1) that may share some, and possibly all, of the features of first article 101 as described herein and shown in the figures.

Figure 11:
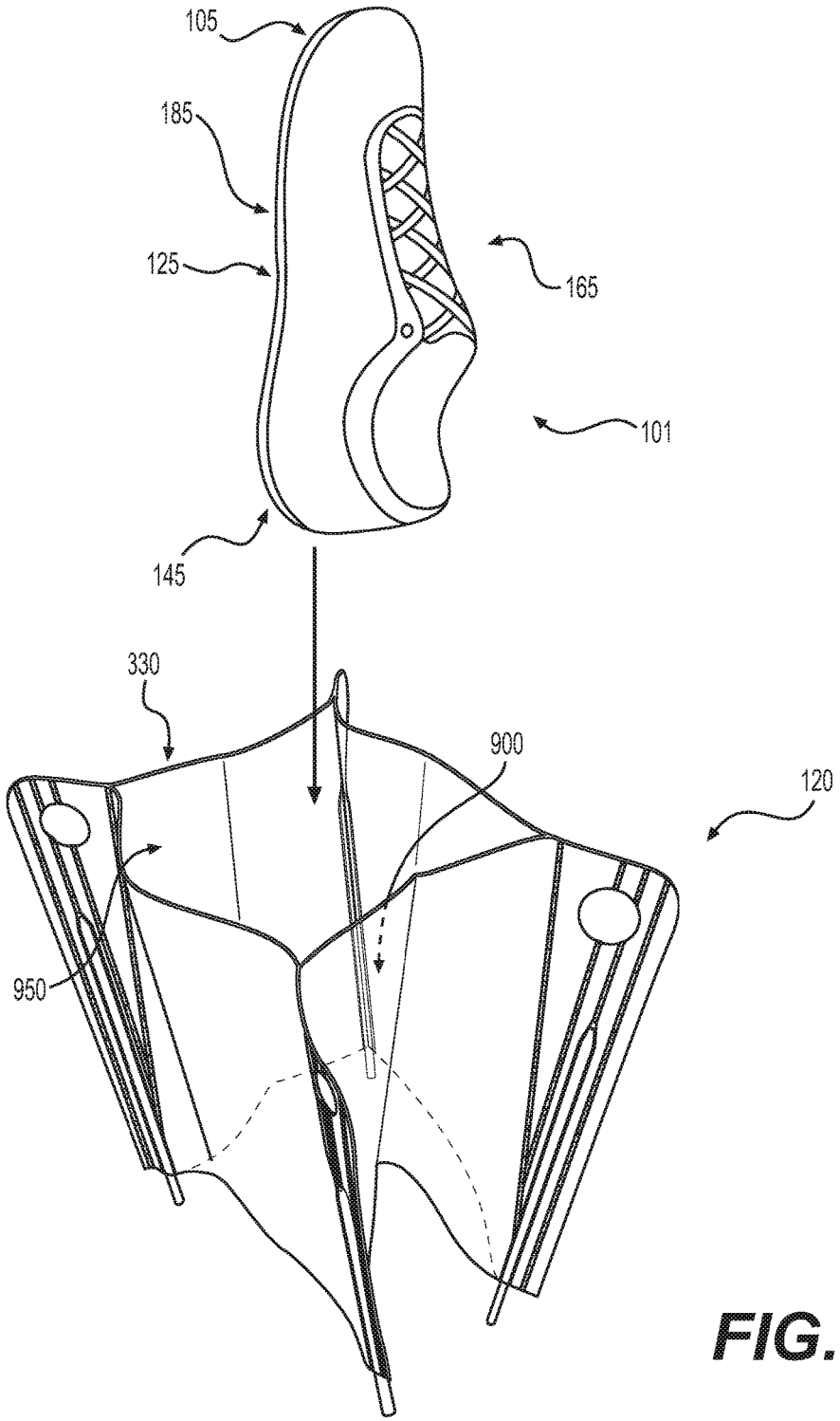
FIG. 11 is an isometric view of an embodiment of a steaming apparatus and an article of footwear.
Figure 12:
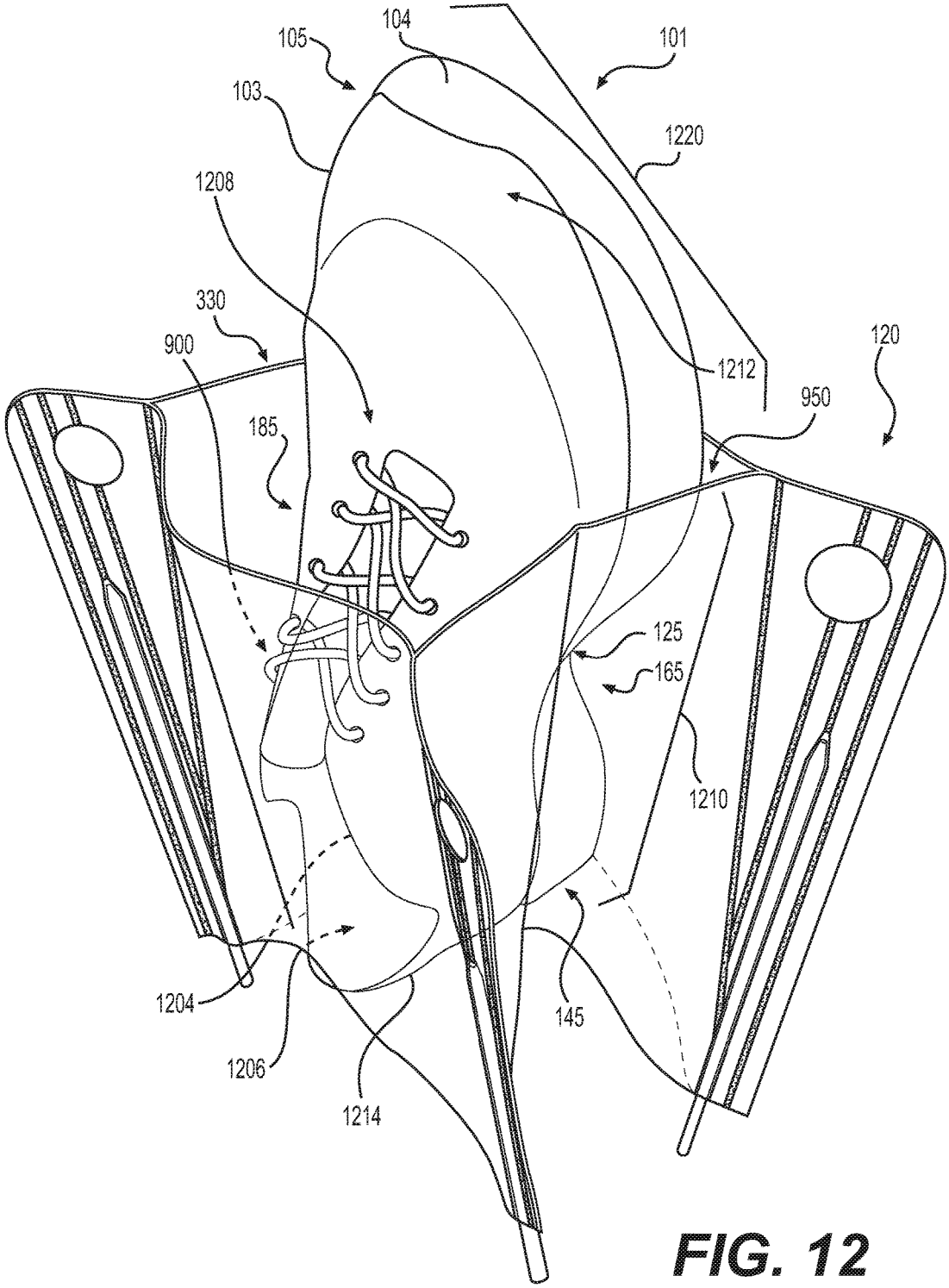
FIG. 12 is an isometric view of an embodiment of an article of footwear within a steaming apparatus.

In FIG. 11, an isometric view of an erected steaming apparatus 120 is depicted with opening 950 along receiving end 330 positioned upward and nearer to first article 101. First article 101 is shown directly above steaming apparatus 120, in a step prior to insertion of the article within steaming chamber 900. In FIG. 12, first article 101 has been inserted into steaming chamber 900 of steaming apparatus 120. In different embodiments, due to the configuration of steaming chamber 900, different portions of first article 101 can be located within the chamber, while other portions of first article 101 remain exposed or outside of steaming chamber 900. Thus, in some embodiments, steaming chamber 900 can enclose or cover different portions of first article 101. In some embodiments, steaming chamber 900 can enclose all or substantially all of first article 101. In other embodiments, there may be a portion of first article 101 that extends outward and upward and is exposed (i.e., is not enclosed within the various surfaces of steaming chamber 900). For purposes of reference, portion(s) of an article inserted into steaming chamber 900 that are enclosed will be referred to as an inserted portion 1210, and portion(s) of an article that remain outside of steaming chamber 900 after the article has been received by steaming chamber 900 (to the extent generally allowable by the dimensions of steaming chamber 900) will be referred to as an exposed portion 1220.

As described above, in different embodiments, upper 103 may be joined to sole structure 104 and define an interior cavity designed to receive a wearer's foot. For purposes of reference, it can be seen that, in some embodiments, upper 103 includes a throat opening 1206 that provides access for a foot into the interior cavity of first article 101 and is configured to receive a foot of a wearer. Furthermore, first article 101 includes a collar portion 1204, which is a portion of upper 103 that surrounds throat opening 1206. In some embodiments, collar portion 1204 includes the collar and the heel regions of an article. In addition, first article 101 includes a rearmost portion 1214, a vamp portion 1208, and a toe portion 1212. Toe portion 1212 is associated with the region of upper 103 toward the front of first article 101, where the toes would be positioned when a foot is inserted in first article 101. Vamp portion 1208 of upper 103 extends between collar portion 1204 and toe portion 1212. Rearmost portion 1214 is located in heel region 145 at the region that is substantially furthest from toe portion 1212 along the longitudinal axis 180 (see FIG. 2).

In FIG. 12, inserted portion 1210 comprises more than half of the length of first article 101, extending from rearmost portion 1214 and into a substantial extent vamp region 1208. Thus, rearmost portion 1214 is proximate to base portion 310. Furthermore, in FIG. 12, exposed portion 1220 generally comprises the region of vamp portion 1208 forward of the lacing region, and extends to toe portion 1212 (i.e., including the foremost point of first article 101).

Figure 13:
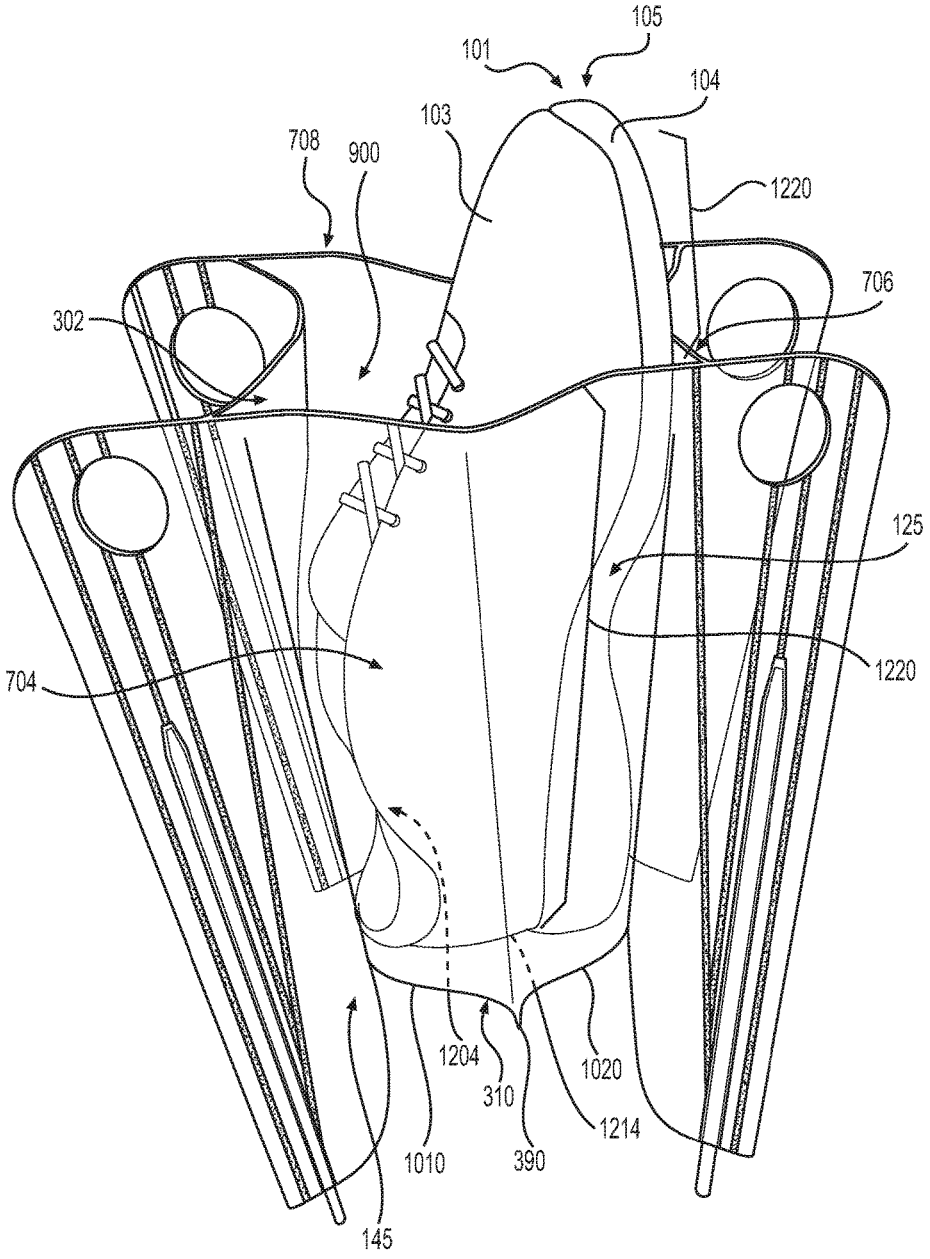
FIG. 13 is an isometric side view of an embodiment of an article of footwear within a steaming apparatus.

As shown in FIG. 13, in some embodiments, rearmost portion 1214 contacts and exerts a force on base portion 310 that is buttressed or supported by the intersection of first base portion 1010, second base portion 1020, and welded lower portion 390. Furthermore, a portion of collar portion 1204 (including the throat opening leading to the interior cavity of first article 101) is disposed near base portion 310 relative to the remainder of first article 101. While first article 101 is oriented in a direction within steaming chamber 900 such that the exterior surface of sole structure 104 (such as an outsole) is disposed adjacent to second panel 706, it should be understood that in other embodiments, first article 101 may be arranged within steaming chamber 900 in any other orientation or arrangement.

Figure 14:
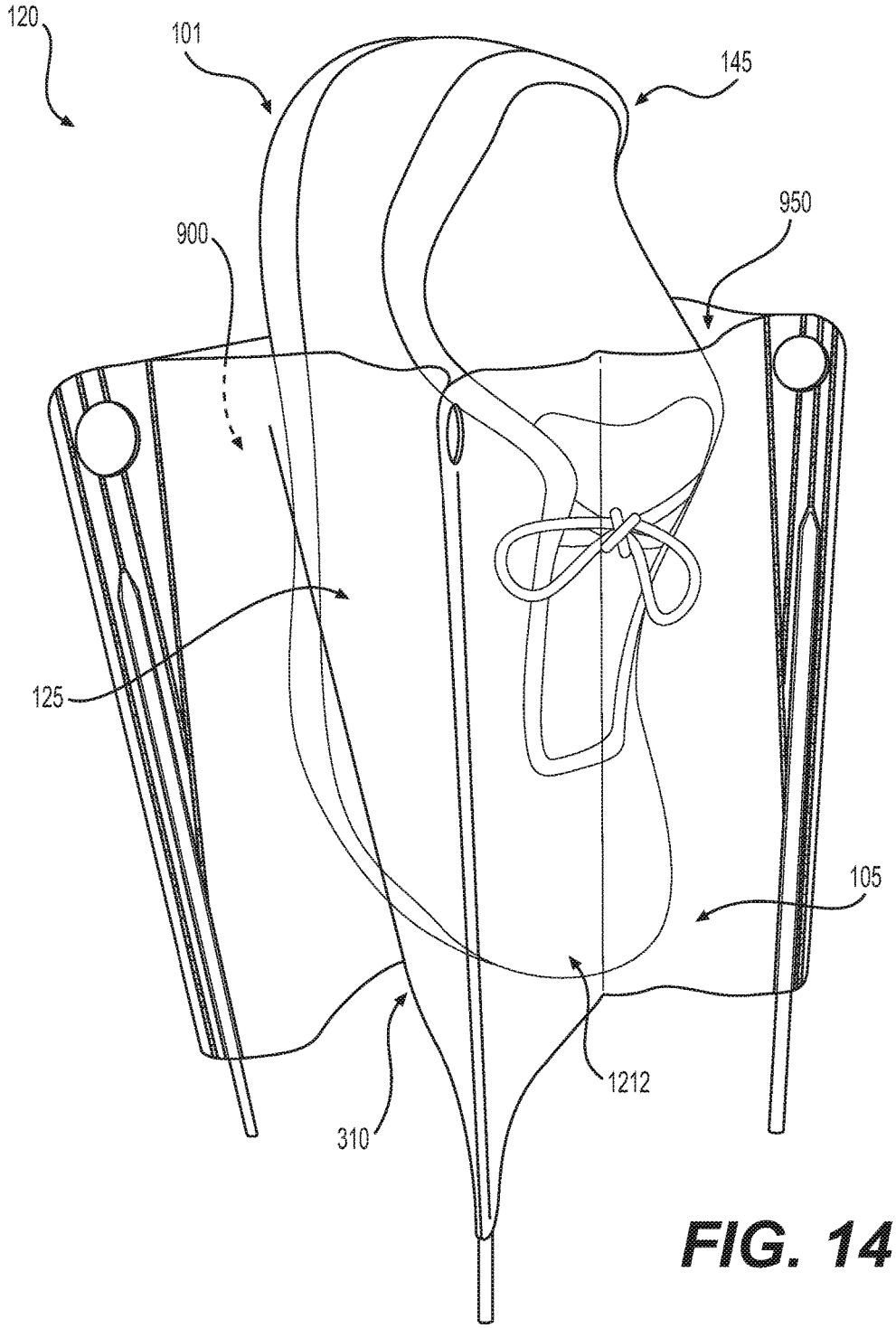
FIG. 14 is an isometric view of an embodiment of an article of footwear within a steaming apparatus.

For example, as shown in FIG. 14, first article 101 may be received by steaming chamber 900 in an inverted position. In some embodiments, for example in cases where stronger or more intense steaming is desired along portions of first article 101 associated with forefoot region 105, first article 101 may be inserted into steaming chamber 900 such that toe portion 1212 is proximate to base portion 310. In another embodiment, a user may wish to steam an entire article of footwear, and can initially insert the article of footwear into steaming chamber 900 in a first position, and if (for example) the exposed portion is not steamed to the extent desired by the user, the article of footwear may be flipped or rotated such that the opposite end (e.g., forefoot region 105) is now inserted into opening 950 and the entire article of footwear can be fully steamed. However, in other embodiments, steaming apparatus 120 may be large enough to receive substantially all of an article of footwear and there may be no exposed portion.

Figure 15:
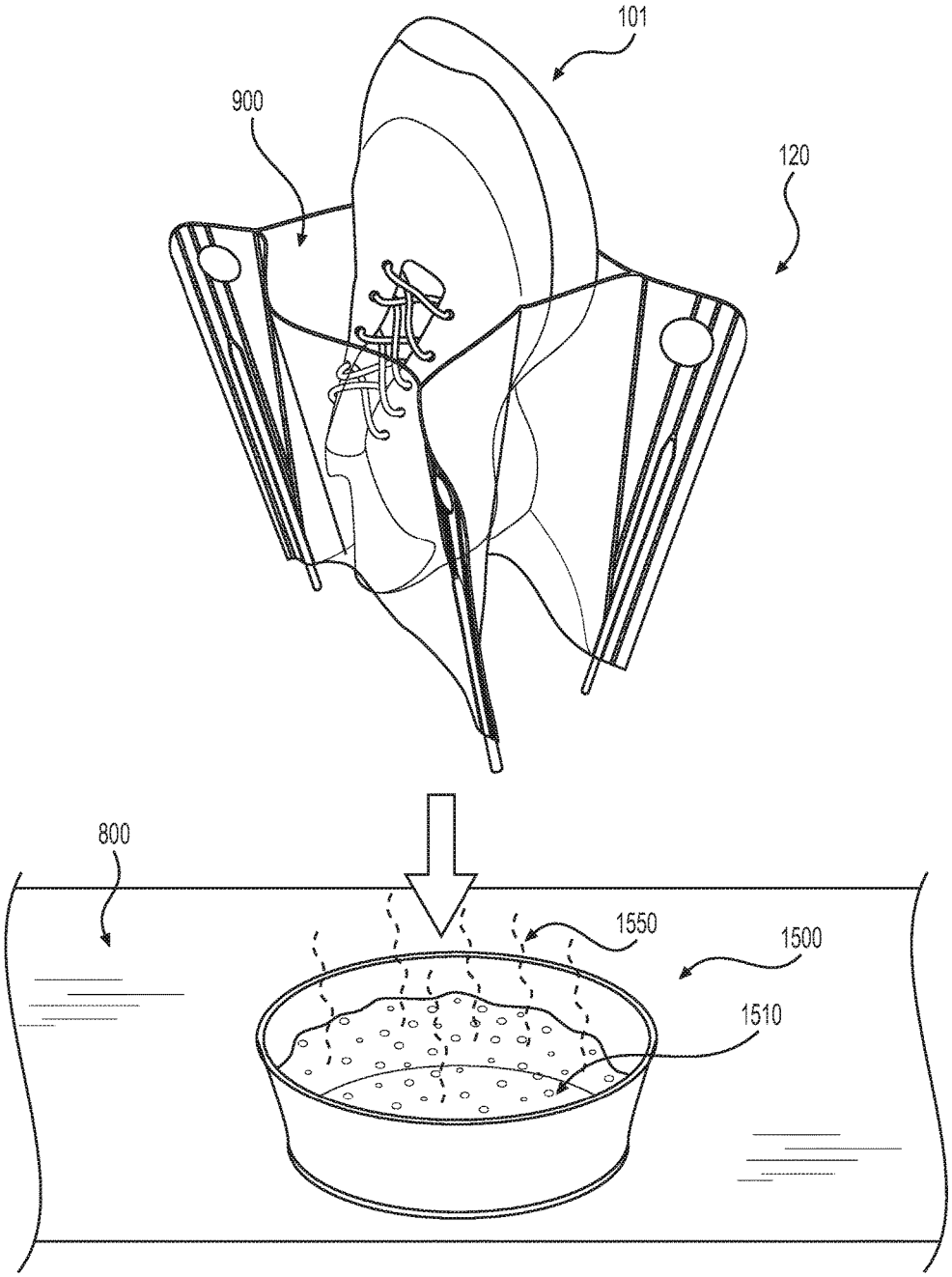
FIG. 15 is an isometric view of an embodiment of an article of footwear within a steaming apparatus located above a steaming source.

Referring now to FIGS. 15-18, an embodiment of a process of using steaming apparatus 120 with an article of footwear is depicted, as the article is subjected to a steam environment. In FIG. 15, a steaming source 1500 is illustrated as a container or cooking pot. It should be understood that steaming source 1500 is shown herein for illustrative purposes only, and that any other type of steaming source or steam generator known in the art may be utilized with the steaming apparatus, including, but not limited to, portable heating devices, battery-powered heating devices, vacuum systems, condensation systems, compression systems, heated and/or moist textiles, distilled or treated water, or other steaming sources.

Furthermore, in one embodiment, steam 1550 may be low-pressure steam, exposing the article to a relatively low level of heat intensity. In other words, the steam may be generated using a latent heat source, rather than sensible heat. Thus, in some embodiments, steam may be produced and/or utilized that is a result of the release of heat from a change in state, rather than a change in temperature. In some embodiments, the steaming apparatus can be used by a consumer without direct incorporation of a heating element or heating component in the steaming chamber or the steaming source container.

In FIG. 15, as an example, steaming source 1500 is shown as a latent heat source. In other cases, a source of steam may be generated by introducing a fluid 1510 such as water contained in steaming source 1500 to a heat source, including, but not limited to, a microwave, an oven, a stovetop, a heating coil, as well other sources of steam. Thus, steaming source 1500 may be heated by any means or mechanism known in the art for generating or providing heat. In some embodiments, steaming source 1500 may be prepared for use with a steaming apparatus by increasing the heat content of steaming source 1500 such that steaming source 1500 begins to release or emit steam 1550, as shown in FIG. 15. Once a particular amount or type of steam 1550 is being released by steaming source 1500 and/or a predetermined temperature is measured as associated with steaming source 1500, steaming source 1500 can be moved to or deposited on surface 800. After steaming source 1500 is securely positioned on surface 800, steaming apparatus 120 may be positioned over steaming source 1500, as represented schematically by an arrow in FIG. 15.

Figure 16:
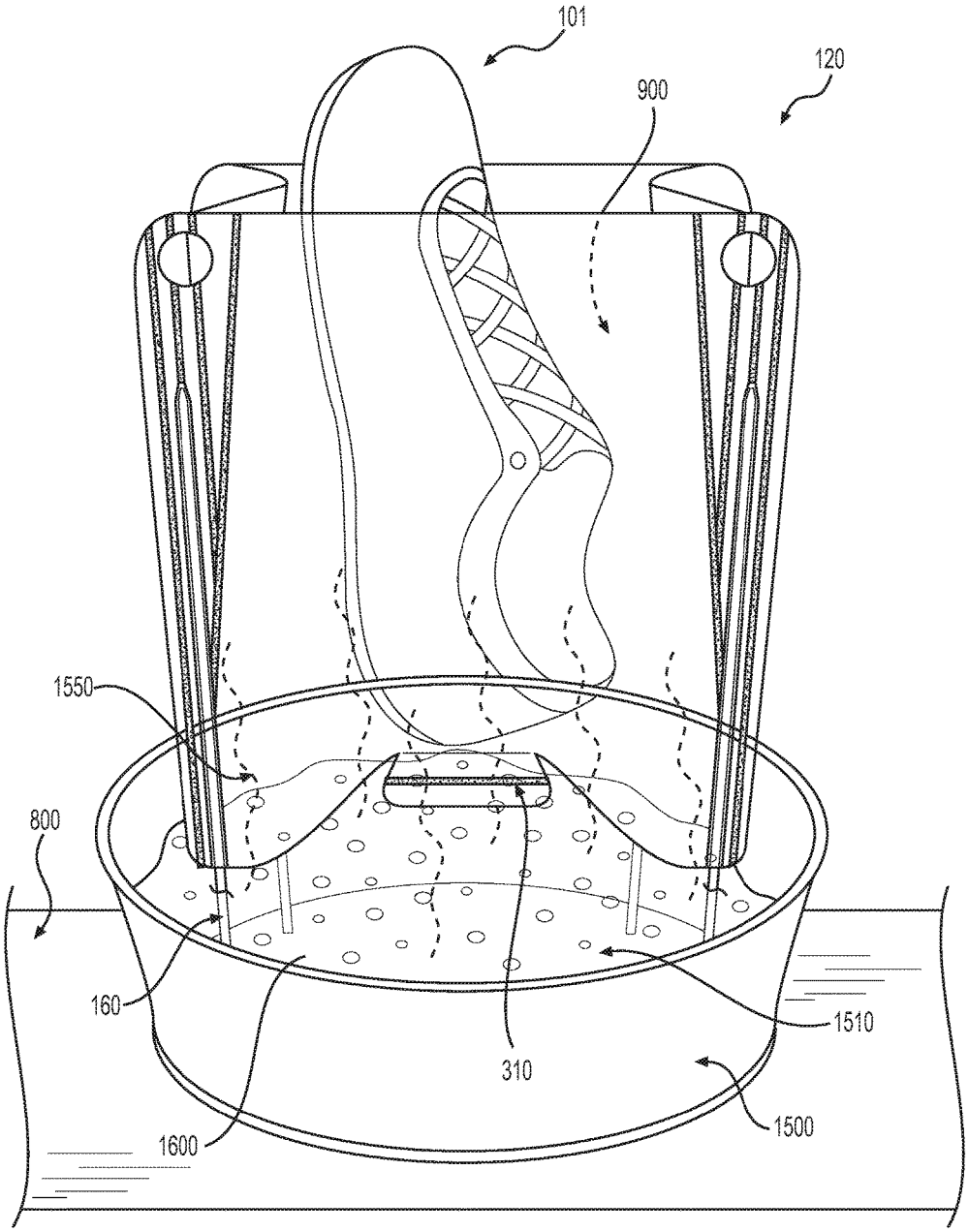
FIG. 16 is an isometric view of an embodiment of an article of footwear within a steaming apparatus located upon a steaming source.
Figure 17:
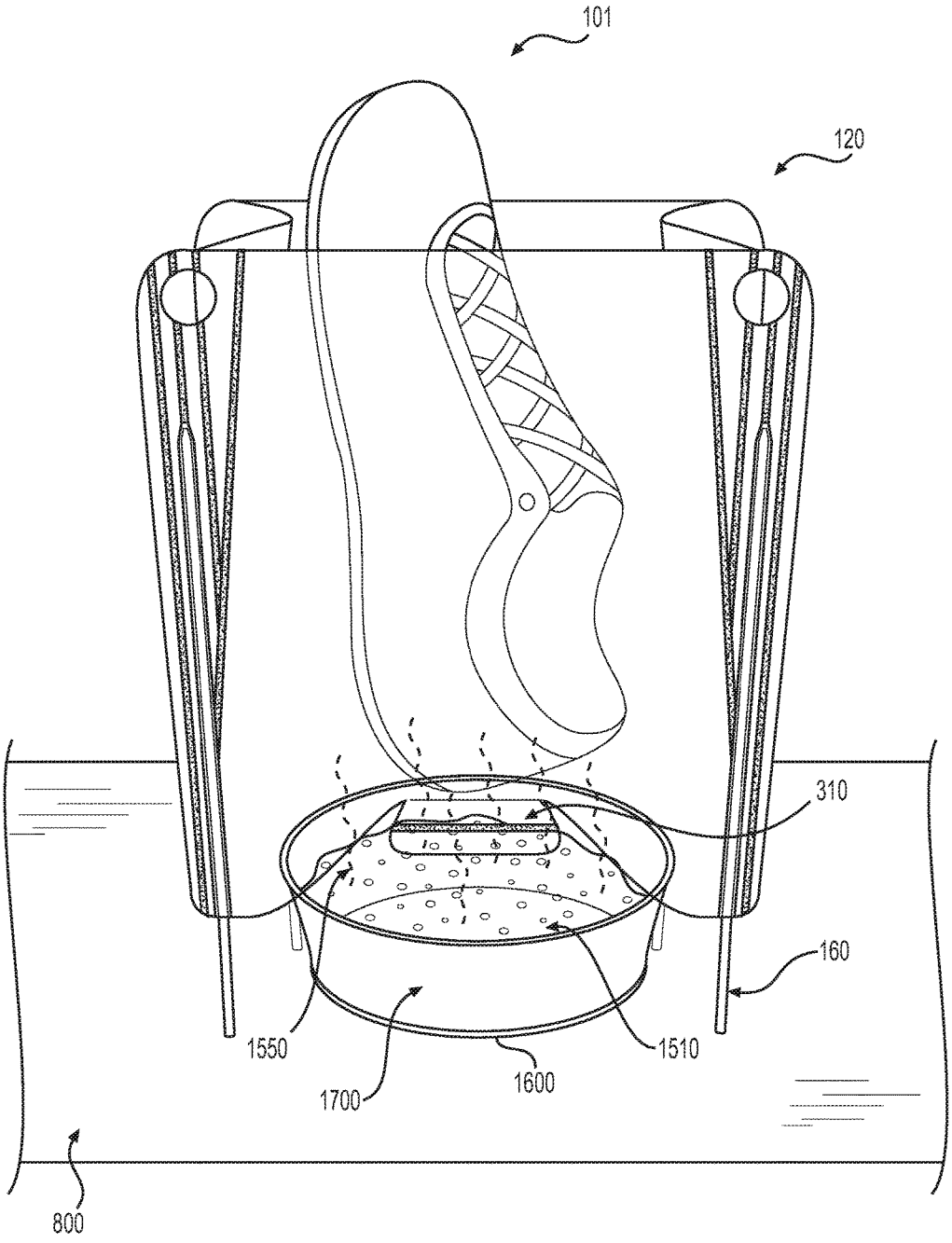
FIG. 17 is an isometric view of an embodiment of an article of footwear within a steaming apparatus located above a steaming source.

As shown in FIG. 16, base portion 310 of steaming apparatus 120 is now disposed substantially directly over steaming source 1500, and steam 1550 may rise from steaming source 1500 through apertures (see FIG. 10) and into steaming chamber 900 in some cases. As described earlier, the base end of each of elongated elements 160 is configured to secure the erected steaming apparatus 120 on a surface. In FIG. 16, the surface comprises an interior bottom surface 1600 of steaming source 1500. Thus, in some embodiments, steaming apparatus 120 can be disposed directly in the container comprising steaming source 1500, where the dimensions of steaming apparatus 120 and the spacing between elongated elements 160 are smaller than the dimensions of the steaming source utilized.

In other embodiments, the dimensions of a steaming apparatus can be larger than those of the steaming source. For example, in FIG. 17, another embodiment of the use of the steaming system is depicted. In this case, the structure of steaming apparatus 120 extends above and over a second steaming source 1700. As noted above, the lengths of elongated elements 160 can vary, and in some embodiments, a user may incorporate elongated elements 160 of greater length to enable the use of steaming apparatus 120 with a variety of differently sized steaming source containers. For example, with containers that have taller sidewalls, a user may insert relatively longer elongated elements into the channels 360 (see FIG. 3) of steaming apparatus 120.

Figure 18:
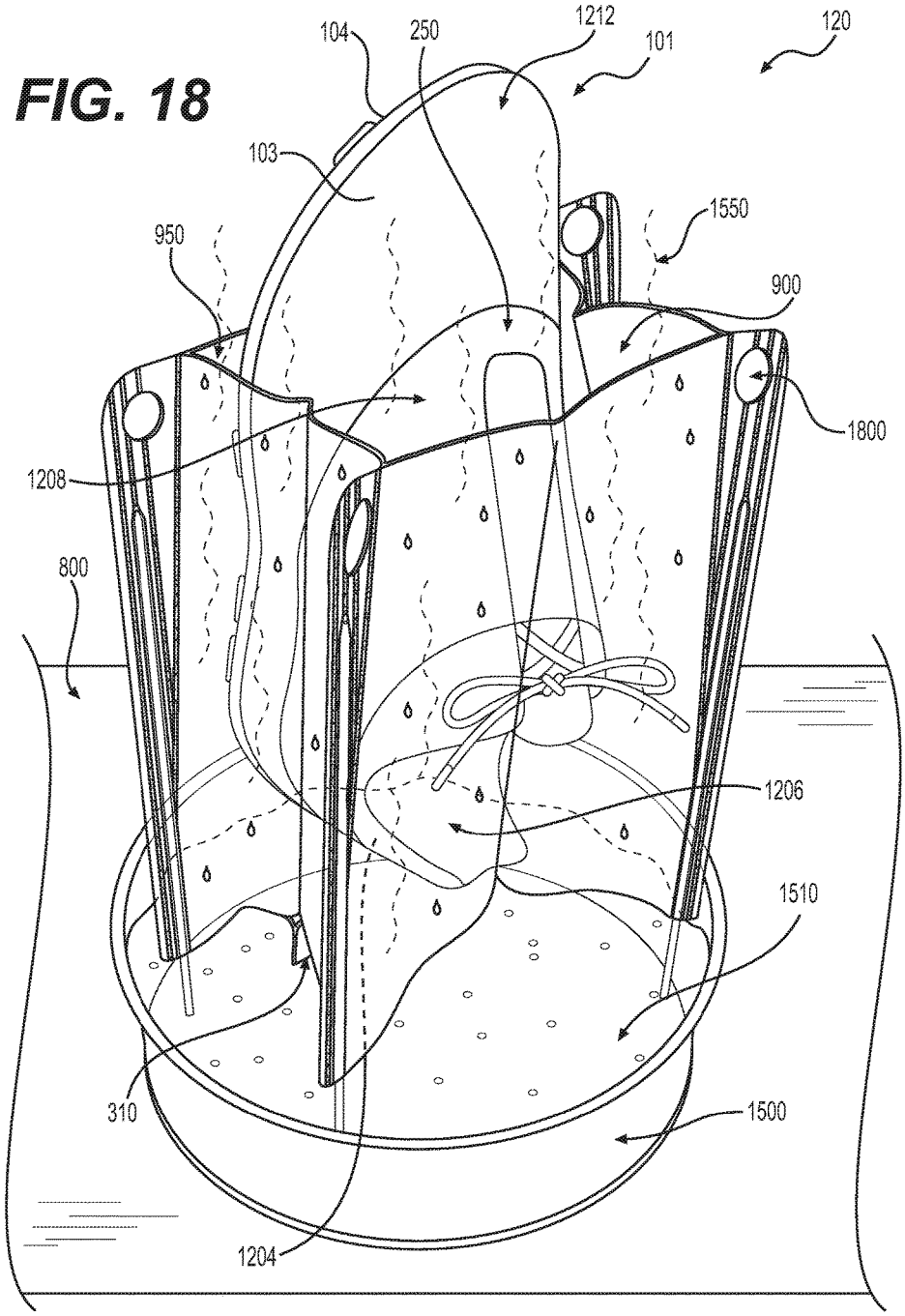
FIG. 18 is an isometric view of an embodiment of an article of footwear being steamed within a steaming apparatus.

Referring now to FIG. 18, first article 101 is depicted within steaming chamber 900, and positioned above steaming source 1500. In some embodiments, steam 1550 may begin to flow through one or more apertures (see FIG. 10) and travel near and/or around first article 101. In one embodiment, apertures near or within base portion 310 can allow steam to enter into steaming chamber 900 and subject first article 101 to a steam environment within the chamber. Steam 1550 may fill a substantial volume of steaming chamber 900 in some embodiments, though in some embodiments, some steam may escape from steaming apparatus 120 through regions around first article 101 associated with opening 950. Thus, it can be understood that first article 101 has been placed in proximity to a source of steam 1550.

As illustrated in FIG. 18, steam 1550 can rise through any apertures and surround or contact various portions of first article 101, including any customizable portions. In one embodiment, steam 1550 can flow through throat opening 1206 and into an interior void of first article 101. Thus, in one embodiment, steam 1550 is able to move or flow around the interior void of an article of footwear. Furthermore, steam 1550 may move toward and contact portions of upper 103 associated with collar portion 1204, vamp portion 1208, and toe portion 1212. This direct application of steam 1550 along both an outer (external) surface of upper 103 and an inner or interior surface of upper 103 can improve the customization process in some embodiments. For example, there can be a more even or uniform exposure of the upper materials to the steam in such cases.

The configuration of steaming apparatus 120 and the apertures in base portion 310 can facilitate the steaming of first article 101 in different embodiments. In one embodiment, the arrangement of the base portion as described herein may increase the stability of first article 101 while first article 101 is positioned in steaming chamber 900. In addition, the arrangement of the substantially continuous sidewalls comprising steaming chamber (i.e., first panel, second panel, first side panel, and second side panel) allows first article 101 to maintain its position and at the same time can maximize the surface area of first article 101 that is in direct contact with or exposed to steam 1550. Furthermore, the structure of steaming chamber 900 can allow articles of various types, sizes, and configurations to be inserted and securely received by steaming apparatus 120. Thus, in some embodiments, steaming apparatus 120 can facilitate the flow of steam to articles of different types and shapes, allowing various articles to be steamed using a substantially similar steaming apparatus configuration. In some cases, this can streamline the manufacturing of steaming apparatuses such that substantially similar steaming apparatuses can be used with a variety of different articles (e.g., articles of footwear designed for different sports or activities, etc.), increasing efficiency and ease of production.

Furthermore, in embodiments where the article to be customized comprises an article of footwear, a range of footwear sizes may be used with steaming apparatus 120. For example, in some embodiments, steaming chamber 900 and/or opening 950 may be large enough to accommodate footwear between standard US shoe sizes 0-17. In another embodiment, steaming apparatus 120 may be used with footwear greater than a US size 17. Furthermore, the arrangement of base portion 310 may facilitate the stable placement of articles of various sizes in steaming chamber 900, as discussed above.

In some embodiments, the desired duration of exposure to steam 1550 may be determined by the user and/or the preferences of the user. In other embodiments, the duration may be recommended by the manufacturer. The duration of time may vary and allows the article of footwear to be exposed to a steam environment for a sufficient amount of time to become moldable. In some cases, the duration of time may vary depending on the type of article of footwear. In other cases, the duration of time may vary depending on the size of the article of footwear or may be the same for all types of articles of footwear. In some cases, the duration of exposure of the article to the steam environment may be between 20 seconds and 5 minutes. For example, when steaming articles that comprise various materials, the articles may require a greater—or lesser—length of exposure time to steam in order to achieve the pliability necessary for customization. In another embodiment, the materials used in the articles may be relatively more delicate, and a shorter exposure may be desired.

It should be understood that in different embodiments, steaming apparatus 120 may be operated by any person configured (i.e., trained) to operate the apparatus. Furthermore, in order to facilitate the use of steaming apparatus 120, the system may include provisions for instructing a user about how to operate steaming apparatus 120. In one embodiment, steaming apparatus 120 can include a set of instructions. Generally, the instructions can be supplied in any format. In some cases, there may be a printed copy of instructions, such as a booklet or a digital storage device. In other embodiments, instructions may be located directly on container 100 (see FIG. 1). For example, in one embodiment, an interior side or outer side of lid 110 (see FIGS. 1 and 2) may include a set of instructions that are resistant to damage from moisture. This may facilitate the use of steaming apparatus 120 by individuals who are unfamiliar with the operation of steaming apparatus 120 and can allow the system to be used relatively quickly (i.e., within a short period of time) by most laypeople.

In different embodiments, steaming apparatus 120 may include provisions for rapidly evacuating steam 1550 from the system. As depicted in the figures, the configuration of one or more grasping holes 1800 in steaming apparatus 120 may allow for the ready removal of the steaming system and article from the steaming source by a user, and the prompt release of steam 1550 in a short period of time after steaming of an article is accomplished. In one embodiment, the rapid evacuation of steam 1550 may allow a user to easily access the article soon after the removal of the steaming apparatus from the steaming source. This feature may further facilitate the use of steaming apparatus 120 by quickly lowering the temperature of steaming apparatus 120 in order to allow the handling of the apparatus by a person and/or prepare the apparatus for use with a second (or additional) article. In situations where steamed articles are needed quickly (e.g., for players to use before a game), this feature may be significant. Thus, it should be understood that steaming apparatus 120 may be used for steaming at least two articles of footwear in some embodiments, wherein a first article may be inserted into the steaming apparatus, steamed, and removed, and followed by at least a second article that may be subsequently inserted into the steaming apparatus, steamed, and removed.

In different embodiments, the method of custom fitting an article of footwear through steaming as described herein results in a customized article of footwear that closely fits the shape and contour of the foot that was inserted in the article of footwear while it cooled. Thus, steaming apparatus 120 may be capable of producing articles of footwear that are customizable to a user's foot. Moreover, the production of the steamed articles can occur relatively quickly, and may be as short as the combined time needed to ready a steaming source, associating the steaming source with the steaming apparatus, inserting an article into the steaming chamber, waiting for a preferred duration of time, and removing the article from the steaming apparatus. Although the time required for each step could vary in different embodiments, some embodiments could provide a total time of less than 5 minutes. In at least some embodiments, the time required for each step may be selected so that the total customization time (including the fitting to a user's foot) is between 15 and 30 minutes. In still further embodiments, the total customization time is less than 15 minutes.

Thus, steaming apparatus 120 may include provisions for facilitating the customization of articles in different environments and locations. For example, in situations where frequent "breaking-in" of apparel is needed (e.g., sports players who may use over 7-12 pairs of articles of footwear each season) steaming apparatus 120 may provide increased convenience, as well as great utility, by allowing players to have articles quickly steamed for customization soon before a match or sporting event. In another embodiment, some users may have injuries or conditions that require the use of specialized ankle or footwear support. Other users may appreciate the convenience of customization that can occur at their own home, or in a location of their choosing. Furthermore, in some embodiments, the articles selected for customization may be purchased within the same shoebox as the steaming apparatus, providing consumers with a kit that is portable and efficient. The use of steaming apparatus 120 can easily allow the user to steam his or her respective footwear and then insert his or her foot into steamed articles to help achieve an improved fit within a few minutes, and at a convenient location.

This description of features, systems, and components is not intended to be exhaustive and in other embodiments, steaming apparatus 120 may include other features, systems, and/or components. Moreover, in other embodiments, some of these features, systems, and/or components could be optional. While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A kit of parts, comprising:

an assembled article of footwear including a customizable portion, the customizable portion being customizable when heated above a predetermined temperature;

a steaming bag configured to receive and hold the assembled article of footwear in a steam environment;

wherein the steaming bag includes a steaming chamber and a plurality of wing portions;

the steaming chamber including a receiving end, a base portion, and a footwear receiving portion, the footwear receiving portion extending between the base portion and the receiving end;

wherein the base portion includes at least one aperture;

wherein the plurality of wing portions extend substantially radially outward from the steaming chamber when the steaming bag is erected;

wherein the plurality of wing portions include a first wing portion that extends outward from a first edge of the steaming chamber; and wherein the first wing portion includes a first channel configured to receive a first elongated element.

2. The kit of parts according to claim 1, wherein the receiving end of the steaming chamber comprises an opening that is sized and dimensioned to receive the assembled article of footwear.

3. The kit of parts according to claim 1, wherein the steaming bag includes four wing portions.

4. The kit of parts according to claim 1, wherein the footwear receiving portion of the steaming chamber comprises four sidewall portions, and wherein the four sidewall portions are arranged to form a substantially continuous and hollow tube.

5. The kit of parts according to claim 1, wherein the footwear receiving portion includes four edge portions, wherein each edge portion of the four edge portions is joined to a wing portion of the plurality of wing portions.

6. The kit of parts according to claim 1, wherein a first outer edge portion and a second outer edge portion of the base portion are welded together in order to provide a support structure for the assembled article of footwear.

7. The kit of parts according to claim 1, wherein the first elongated element has a first length, wherein the first channel has a second length, and wherein the first length is greater than the second length.

8. The kit of parts according to claim 1, wherein the steaming bag is configured to at least partially cover the assembled article of footwear.

9. A steaming bag configured to receive and hold an assembled article of footwear in a steam environment, the steaming bag comprising:

a flattened configuration and an erected configuration;

a steaming chamber including four sidewall portions joined along four edge portions;

four wing portions, wherein each wing portion of the four wing portions is joined to one edge portion of the steaming chamber;

wherein each of the four wing portions includes an elongated channel;

the steaming chamber including a receiving end, a base portion, and a footwear receiving portion, the footwear receiving portion extending upward from the base portion to the receiving end; and wherein each of the four wing portions extends radially outward from the steaming chamber when the steaming bag is in the erected configuration.

10. The steaming bag according to claim 9, wherein the steaming bag is substantially symmetrical about a longitudinal axis in the flattened configuration.

11. The steaming bag according to claim 9, wherein the base portion includes at least one aperture configured to allow steam from an external steam source to pass into the steaming chamber.

12. The steaming bag according to claim 9, wherein each elongated channel of the four wing portions is a blind-hole channel.

13. The steaming bag according to claim 9, wherein the receiving end of the steaming chamber has a horizontal cross-sectional shape that is substantially rectangular when the steaming bag is in the erected configuration.

14. The steaming bag according to claim 9, further including a plurality of elongated elements, wherein each elongated element of the plurality of elongated elements is configured to be received by an elongated channel formed in a wing portion of the steaming bag.

15. The steaming bag according to claim 9, wherein the four wing portions comprise a first wing portion and a second wing portion and wherein the first wing portion and the second wing portion have substantially similar dimensions.

16. The steaming bag according to claim 15, wherein the first wing portion includes a first elongated channel and the second wing portion includes a second elongated channel;

wherein the first elongated channel is configured to receive a first elongated element and the second elongated channel is configured to receive a second elongated element; and wherein the first elongated channel and the second elongated channel have substantially similar dimensions, and the first elongated element and the second elongated element have substantially similar dimensions.

17. The steaming bag according to claim 16, wherein the second elongated channel is also configured to receive the first elongated element, and wherein the first elongated channel is also configured to receive the second elongated element.

18. The steaming bag according to claim 16, wherein the first elongated element has a first portion and a second portion, wherein the first portion is received by the first elongated channel, and wherein the second portion extends outward from the first elongated channel.

19. The steaming bag according to claim 18, wherein the second portion has a free end that is configured to rest upon a surface in the erected configuration.

20. The steaming bag according to claim 9, wherein the four sidewall portions include a first sidewall portion and a second sidewall portion, wherein the first sidewall portion is disposed opposite to the second sidewall portion in the erected configuration, and wherein the first sidewall portion has a first folding crease and the second sidewall portion has a second folding crease.

21. The steaming bag according to claim 20, wherein the first folding crease and the second folding crease are configured to allow the steaming bag to transition between the flattened configuration and the erected configuration.

22. A method of using a steaming bag, comprising:

grasping a first wing portion and a second wing portion of a steaming apparatus;

pulling the first wing portion in a first direction and pulling the second wing portion in a second direction, wherein the first direction is substantially opposite to the second direction; and erecting the steaming bag on a surface including expanding a steaming chamber in the steaming apparatus from a substantially flattened configuration to an open configuration, wherein the steaming chamber comprises four sidewall portions, and wherein the second wing portion is disposed diagonally across from the first wing portion when the steaming chamber is in the open configuration.

23. The method of claim 22, further comprising:

inserting an assembled article of footwear having a customizable portion into the steaming chamber in the steaming apparatus; and introducing steam into the steaming chamber while the assembled article of footwear is located in the steaming chamber.

24. A method of using a steaming bag, comprising;

grasping a first wing portion and a second wing portion of a steaming apparatus;

pulling the first wing portion in a first direction and pulling the second wing portion in a second direction, wherein the first direction is substantially opposite to the second direction; and erecting the steaming bag on a surface, wherein the step of erecting the steaming bag further comprises arranging a bottom end of a first elongated element to contact the surface, wherein the first elongated element extends from a first channel in the first wing portion.

25. The method of claim 24, wherein the step of erecting the steaming bag further comprises arranging a bottom end of a second elongated element to contact the surface, wherein the second elongated element extends from a second channel in the second wing portion.

26. The method of claim 24, further comprising:

selecting four elongated elements, wherein the four elongated elements are substantially similar in length;

inserting a first elongated element of the four elongated elements into a first channel formed within the first wing portion, wherein a first length of the first elongated element is greater than a second length of the first channel; and inserting a second elongated element of the four elongated elements into a second channel formed within the second wing portion, wherein a third length of the second elongated element is greater than a fourth length of the second channel.

* * * * *